US011591795B2

(12) United States Patent
Friez

(10) Patent No.: US 11,591,795 B2
(45) Date of Patent: Feb. 28, 2023

(54) END CAP FOR CEILING PANEL AND CEILING SYSTEM INCORPORATING THE SAME

(71) Applicant: ARMSTRONG WORLD INDUSTRIES, INC., Lancaster, PA (US)

(72) Inventor: Nicholas J. Friez, Lancaster, PA (US)

(73) Assignee: AWI Licensing LLC, Wilmington, DE (US)

( * ) Notice: Subject to any disclaimer, the term of this patent is extended or adjusted under 35 U.S.C. 154(b) by 4 days.

(21) Appl. No.: 17/158,469

(22) Filed: Jan. 26, 2021

(65) Prior Publication Data

US 2021/0148116 A1 May 20, 2021

Related U.S. Application Data

(63) Continuation of application No. 16/199,723, filed on Nov. 26, 2018, now Pat. No. 10,941,570.

(Continued)

(51) Int. Cl.
*E04B 9/30* (2006.01)
*E04B 9/04* (2006.01)

(Continued)

(52) U.S. Cl.
CPC ..... *E04B 9/30* (2013.01); *E04B 9/04* (2013.01); *E04B 9/0457* (2013.01);

(Continued)

(58) Field of Classification Search
CPC ... E04B 9/04; E04B 9/241; E04B 9/30; E04B 9/366; E04B 2103/04; E04B 2103/06; F21V 15/015
See application file for complete search history.

(56) References Cited

U.S. PATENT DOCUMENTS 1,680,462 A 8/1928 Lesquendieu
2,810,823 A * 10/1957 Guth, Jr. ..... F21S 8/033 362/225

(Continued)

FOREIGN PATENT DOCUMENTS

| | | |
|---|---|---|
| JP | 2016223174 | 12/2016 |
| KR | 100463919 | 1/2005 |
| KR | 200458337 Y1 | 2/2012 |

OTHER PUBLICATIONS

Https://web.archive.org/web/20170919125018/http://www.gratingpacific.com/handrail_components/handrail_rb_wagner_disks_caps (Year: 2017).*

(Continued)

*Primary Examiner* — Babajide A Demuren
*Assistant Examiner* — Daniel J Kenny
(74) *Attorney, Agent, or Firm* — Craig M. Sterner

(57) ABSTRACT

An end cap for a ceiling panel of a ceiling system. The end cap includes a face plate having an inner surface, a bottom edge, a top edge, a first side edge, and a second side edge. A first insertion plate extends from the inner surface of the face plate at the top edge of the face plate. A second insertion plate extends from the inner surface of the face plate at the bottom edge of the face plate. A concealment portion extends from the inner surface of the face plate along the first and second side edges of the face plate. The concealment portion may include an upper section positioned above the first insertion plate and spaced from the first insertion plate by a first gap and a lower section of positioned below the second insertion plate and spaced from the second insertion plate by a second gap.

20 Claims, 20 Drawing Sheets

Related U.S. Application Data

(60) Provisional application No. 62/592,137, filed on Nov. 29, 2017.

(51) Int. Cl.
*E04B 9/36* (2006.01)
*E04B 9/24* (2006.01)
*E04B 9/06* (2006.01)

(52) U.S. Cl.
CPC ..... *E04B 9/0464* (2013.01); *E04B 9/067* (2013.01); *E04B 9/241* (2013.01); *E04B 9/245* (2013.01); *E04B 9/366* (2013.01); *E04B 2103/04* (2013.01); *E04B 2103/06* (2013.01)

(56) References Cited

U.S. PATENT DOCUMENTS 3,027,451 A * 3/1962 Thomsen ..... F21V 11/02 362/225
3,252,262 A 5/1966 Howard
3,934,135 A * 1/1976 Szer ..... F21V 17/164 362/330
4,200,171 A 4/1980 Seymour et al.
5,331,785 A 7/1994 Brak
5,421,556 A 6/1995 Dodge et al.
5,695,174 A 12/1997 Tsia
5,702,090 A 12/1997 Edgman
6,122,875 A 9/2000 Schiedegger et al.
6,279,278 B1 8/2001 Morris
6,662,515 B2 12/2003 Buhrts et al.
6,796,676 B2 * 9/2004 Severtson ..... F21S 8/06 362/225
6,918,213 B2 7/2005 Burkart et al.
7,165,372 B1 1/2007 Skulsky
7,762,409 B2 7/2010 Vickroy
8,046,919 B2 11/2011 Coughlin et al.
10,100,551 B2 10/2018 Pacheco
10,180,241 B1 * 1/2019 Van Winkle ..... F21V 21/005
2002/0104986 A1 8/2002 Lesenskyj
2004/0134162 A1 7/2004 Douglas
2007/0193148 A1 8/2007 Simko et al.
2007/0193173 A1 8/2007 Coughlin et al.
2008/0110121 A1 5/2008 Edmends et al.

OTHER PUBLICATIONS

HDA Engineering, Project: Linear Box 2 Product Specifications, Overall Isometric View, HunterDouglas Architectural. Dec. 5, 2016. US.
HDA Engineering, Project: Linear Box 2 Product Specifications, Panel End Cap; HunterDouglas Architectural. Dec. 5, 2016. US.
HDA Engineering, Project: High Profile Series Product Specifications, End Cap Installation; HunterDouglas Architectural. Sep. 8, 2017. US.
Metalworks Blades-Classics, Brochure: Assembly and Installation Instructions, Armstrong Ceiling & Wall Solutions. US.
Metalworks Baffles, Brochure: Armstrong Ceiling Solutions. US.
Web.archive.org/web/20161016222536/http://epcohardward.com/oval-tube-flanges/ (Oct. 2016).

* cited by examiner

END CAP FOR CEILING PANEL AND CEILING SYSTEM INCORPORATING THE SAME

CROSS-REFERENCE TO RELATED APPLICATIONS

The present application is a continuation of U.S. patent application Ser. No. 16/199,723, filed on Nov. 26, 2018, which claims the benefit of U.S. Provisional Patent Application Ser. No. 62/592,137, filed on Nov. 29, 2017. The disclosures of the above applications are incorporated herein by reference.

BACKGROUND

Ceiling panels—such as vertical metal blades—may be placed in a ceiling system to impart desired aesthetic value to a room environment. These vertical ceiling panels are produced as factory-supplied panels having predetermined dimensions. Difficulties exist when installing such factory-supplied panels in a ceiling system that require panels of varying dimensions. Either there various differently-sized panels must be ordered to an installation site—thereby making the building process more inconvenient, or such factory-supplied panels may be improperly modified at the time of installation to fit the custom needs of the ceiling system. However, such customization of factory-supplied panels is undesirable as it creates noticeable flaws in the panel that otherwise do not exist before such modification. Therefore, while the dimensions of the panel may be modified, the overall aesthetic appearance of such panel is greatly damaged—thereby negatively impacting the resulting ceiling system. Thus, there exists a need for a ceiling system comprising factory supplied ceiling panels that may be modified at the time of installation while avoiding the aesthetic setback issues created by such customization.

BRIEF SUMMARY

The present invention may be directed to a ceiling panel assembly comprising: a panel body having an inner surface defining an internal cavity having a first open end defined by a first side edge of the panel body; a first end cap comprising a face plate, an insertion portion extending from an inner surface of the face plate, and a concealment portion extending from the inner surface of the face plate; and the first end cap coupled to the panel body so that: (1) the insertion portion extends into the internal cavity; (2) the concealment portion wraps around at least a portion of the first edge and is adjacent an outer surface of the panel body; and (3) the end face plate encloses the first open end of the internal cavity.

In one embodiment, the invention may be a ceiling panel assembly comprising: a panel body having an inner surface defining an internal cavity having a first open end defined by a first side edge of the panel body; a first end cap comprising a face plate, an insertion portion extending from an inner surface of the face plate, and a concealment portion extending from the inner surface of the face plate; and the first end cap coupled to the panel body so that: (1) the insertion portion extends into the internal cavity; (2) the concealment portion wraps around at least a portion of the first edge and is adjacent an outer surface of the panel body; and (3) the end face plate encloses the first open end of the internal cavity.

In other embodiments, the present invention includes a ceiling panel assembly comprising: a panel body having an inner surface defining an internal cavity having a first open end defined by a first side edge of the panel body; a first end cap comprising: a face plate; a first insertion plate extending from the inner surface of the face plate at an upper end of the face plate; and a second insertion plate extending from the inner surface of the face plate at a lower end of the face plate; the first end cap coupled to panel body so that: (1) the end face plate encloses the first open end of the internal cavity; and (2) the first and second concealment plates are biased into contact with the inner surface of the panel body to retain the first end cap to the panel body via a friction-fit.

Other embodiments of the present invention include a ceiling system comprising one or more of the aforementioned ceiling panel assemblies, the ceiling system further comprising: an overhead support structure; and at least one of the ceiling panel assembly mounted to the overhead support structure, the ceiling panel assembly.

In other embodiments, the present invention may include an end cap for a panel body of a ceiling baffle, the end cap comprising: a face plate; an insertion portion extending from an inner surface of the face plate; a concealment portion extending from the inner surface of the face plate; and a gap being formed between an inner surface of the concealment portion and an outer surface of the insertion portion that is configured to receive an edge portion of the panel body.

Other embodiments of the present invention include a method of installing a ceiling system comprising: providing an end cap and a first panel body extending along a longitudinal axis from a first side edge that is opposite a second side edge; removing a longitudinal portion comprising the first side edge from the first panel body to create shortened first panel body comprising a non-factory side edge opposite the second side edge; attaching the end cap to the shortened panel body such that the end cap conceals at least a portion of the non-factor side edge; and mounting the shortened first panel body to an overhead support grid.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
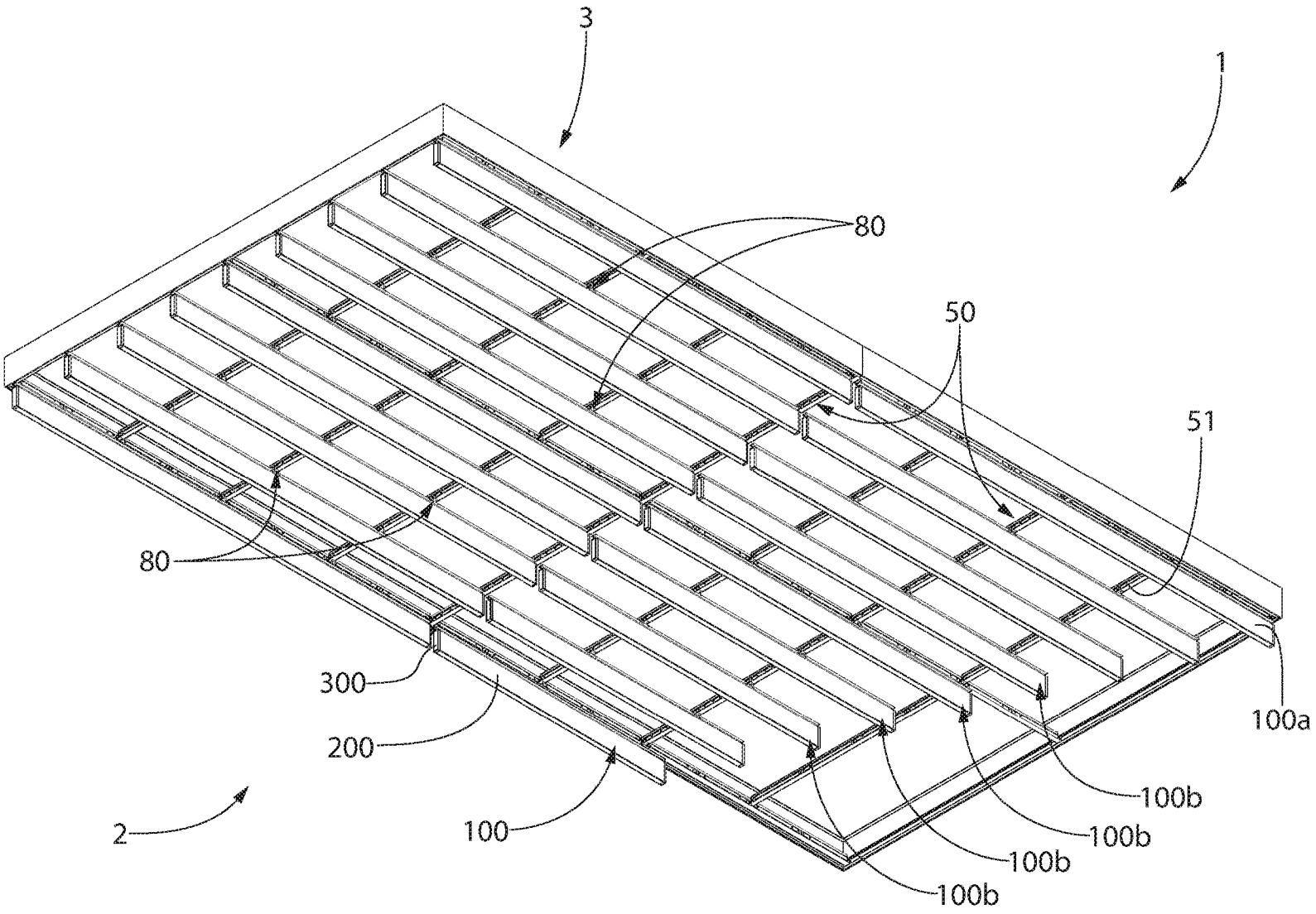
FIG. 1 is a perspective view of a ceiling system comprising a plurality of ceiling panel assemblies according to the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 2:
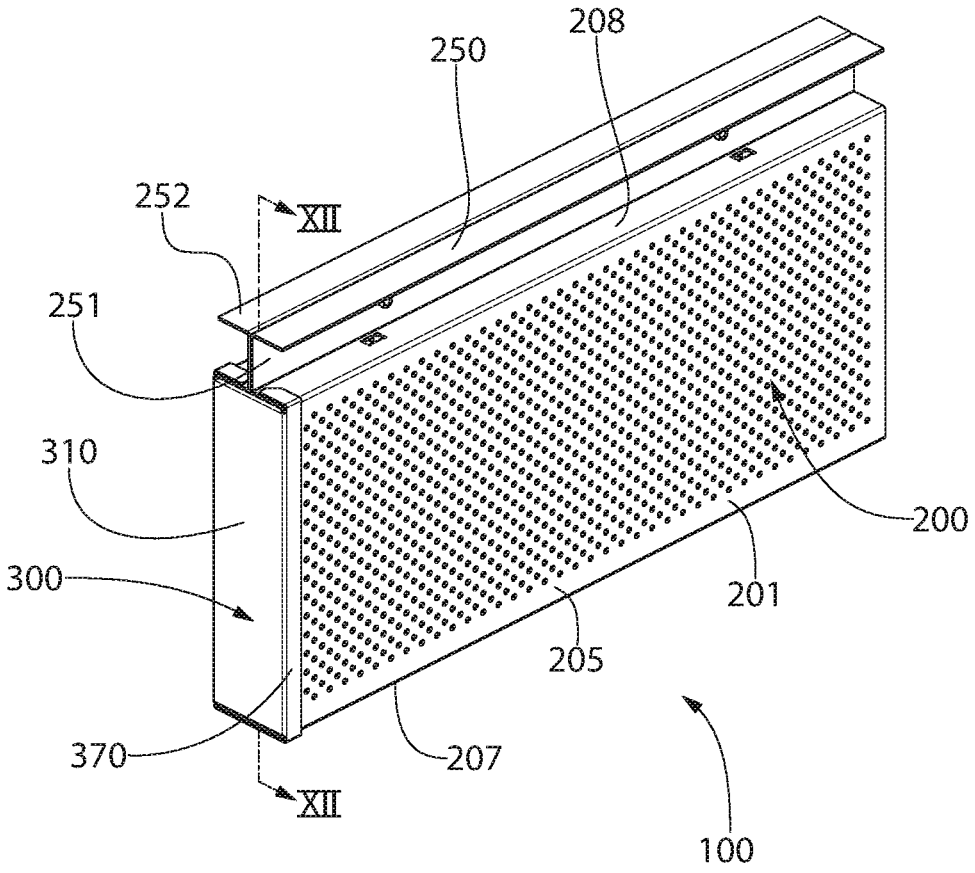
FIG. 2 is a perspective view of the ceiling panel assembly of the present invention.
Figure 3:
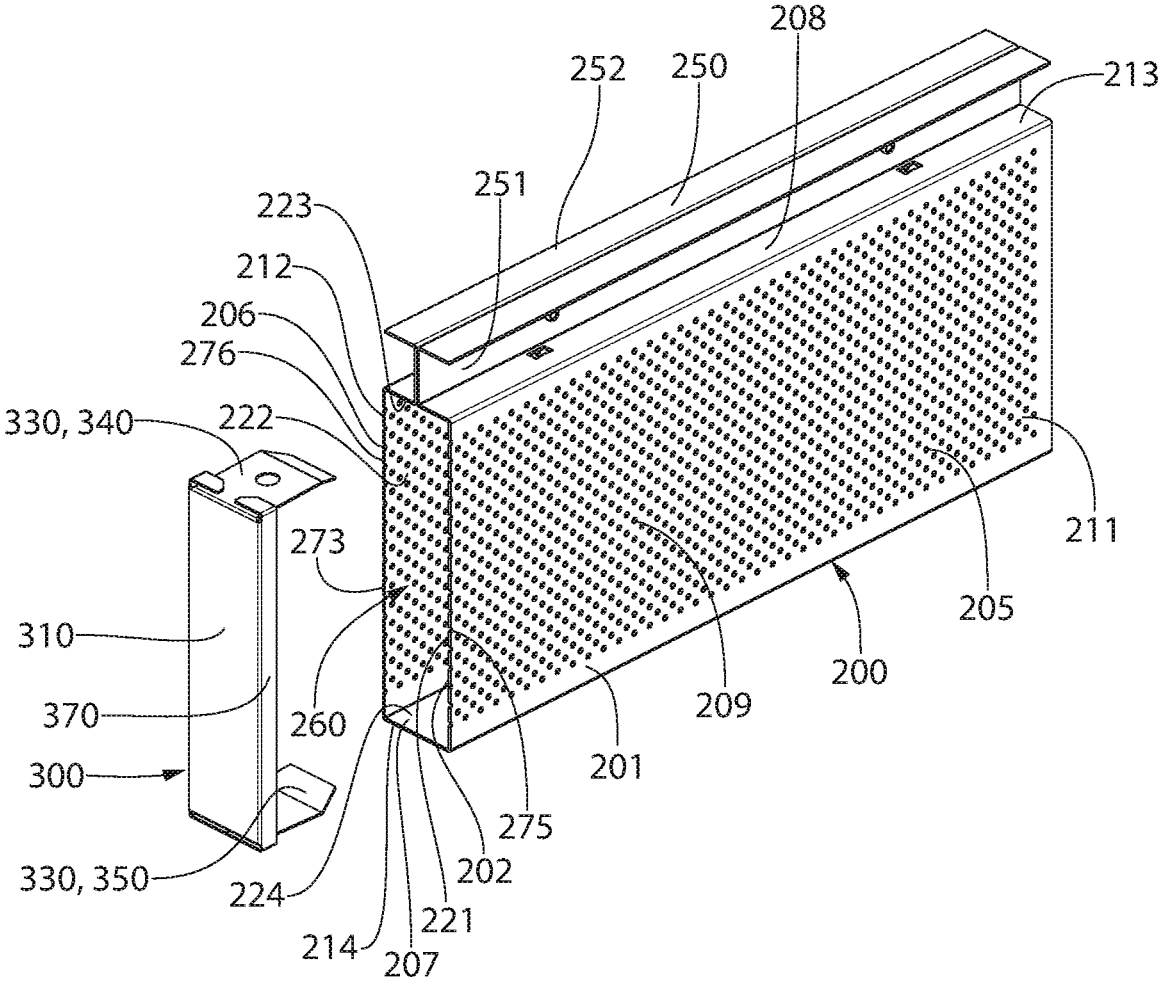
FIG. 3 is a perspective view of an end cap in an uninstalled state from a panel body.
Figure 4:
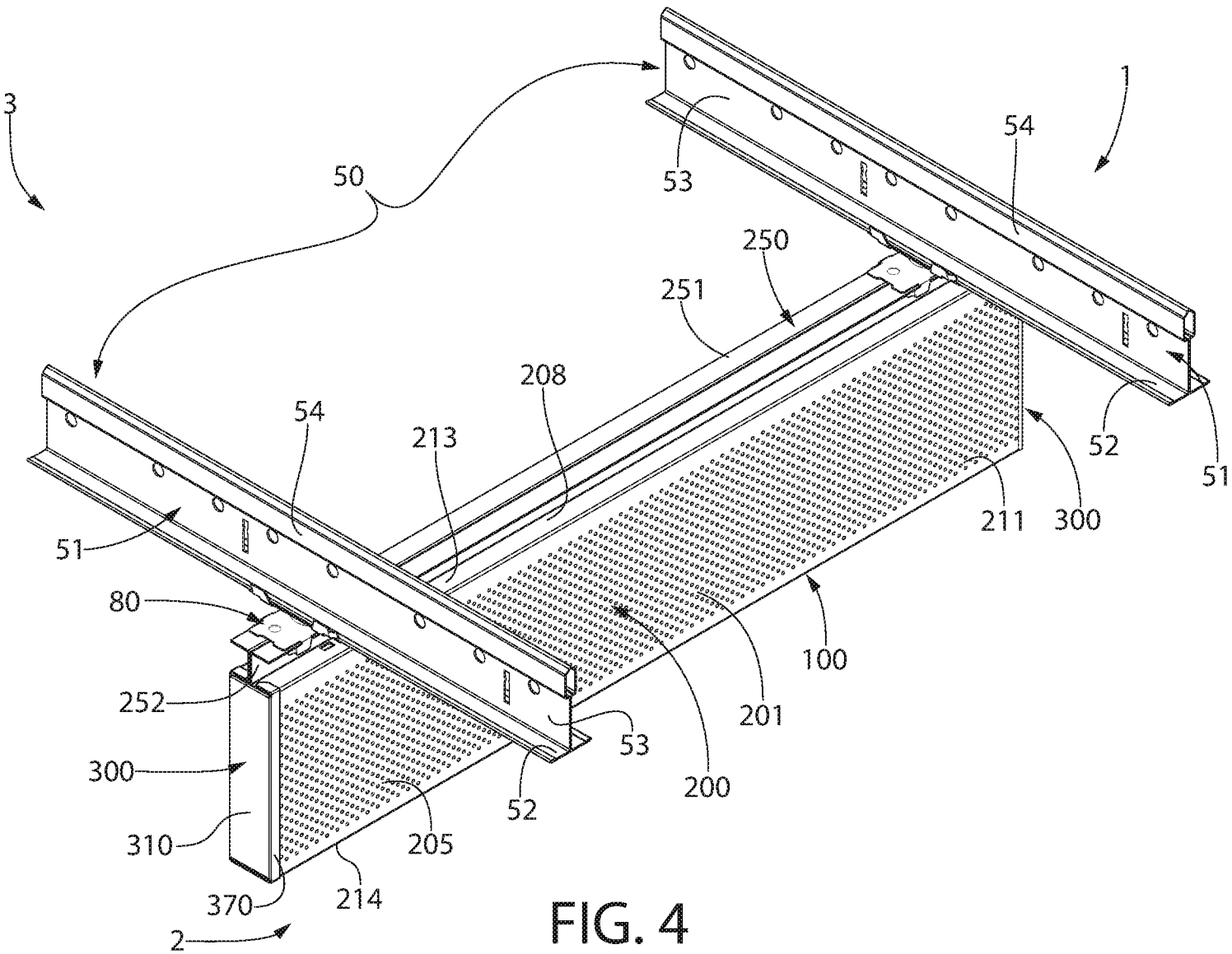
FIG. 4 is a top perspective view of the ceiling panel assembly installed within the ceiling system according to the present invention.
Figure 5:
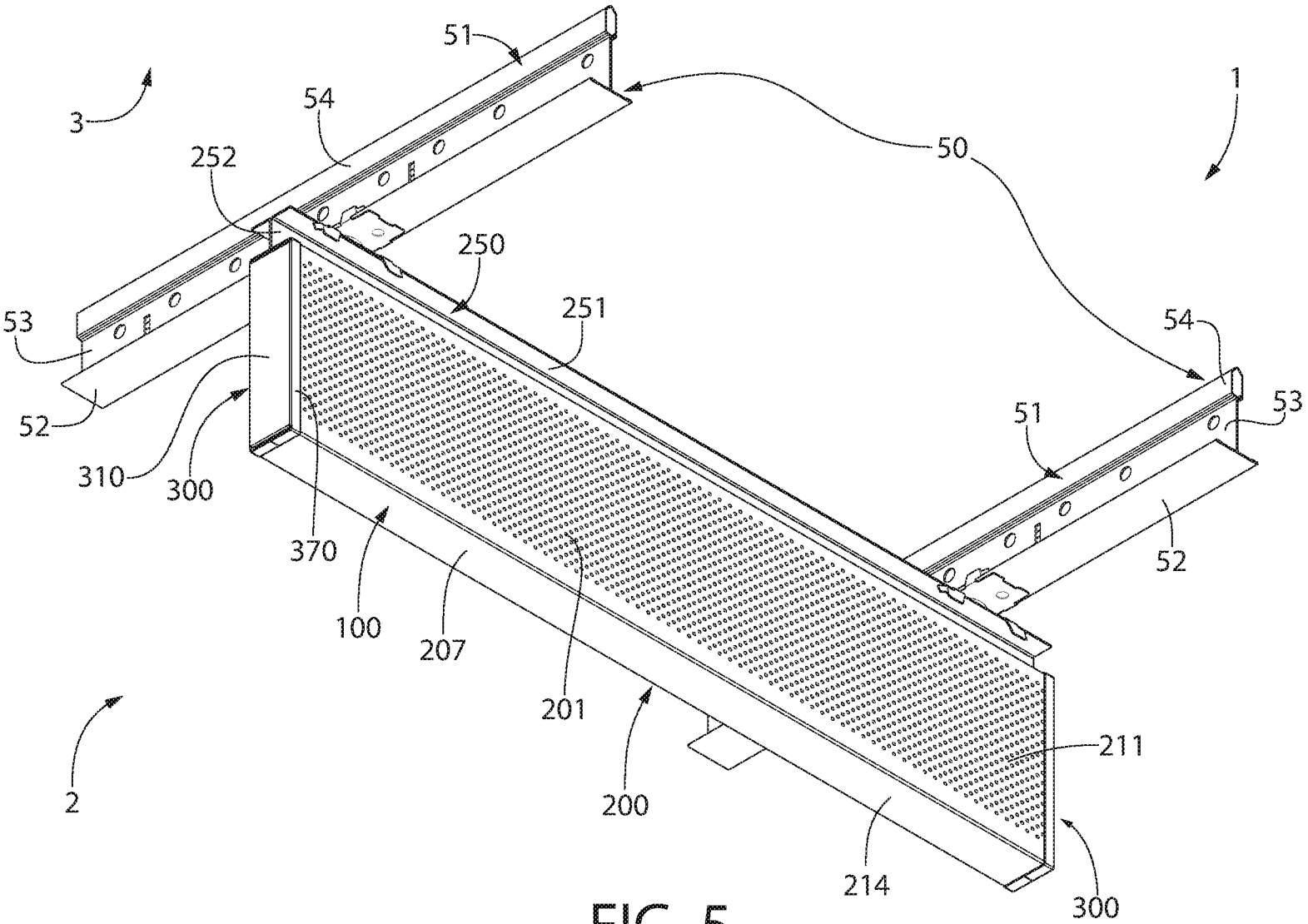
FIG. 5 is a bottom perspective view of the ceiling panel assembly installed within the ceiling system according to the present invention.
Figure 7:
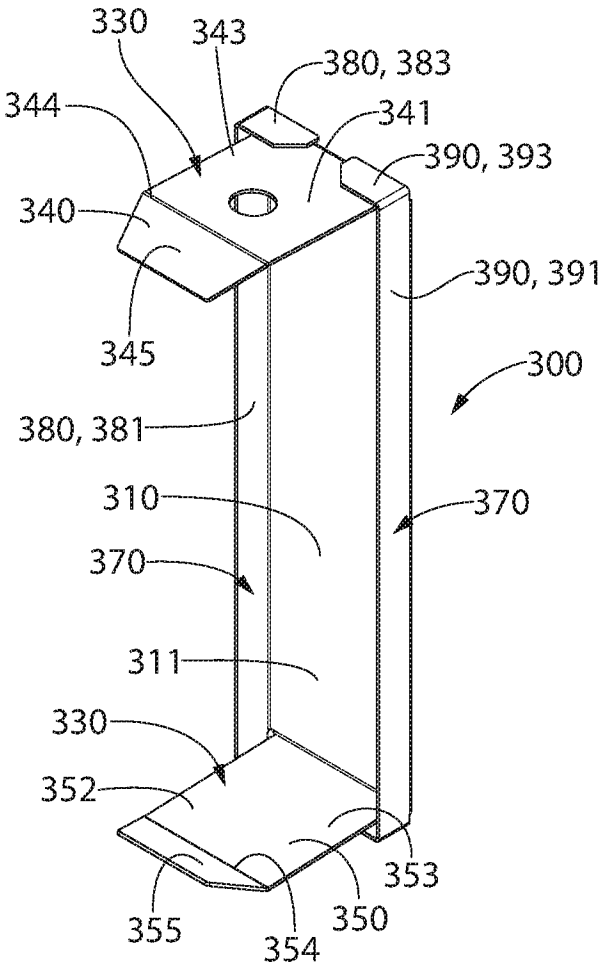
FIG. 7 is a front top perspective view of the end cap according to the present invention.
Figure 6:
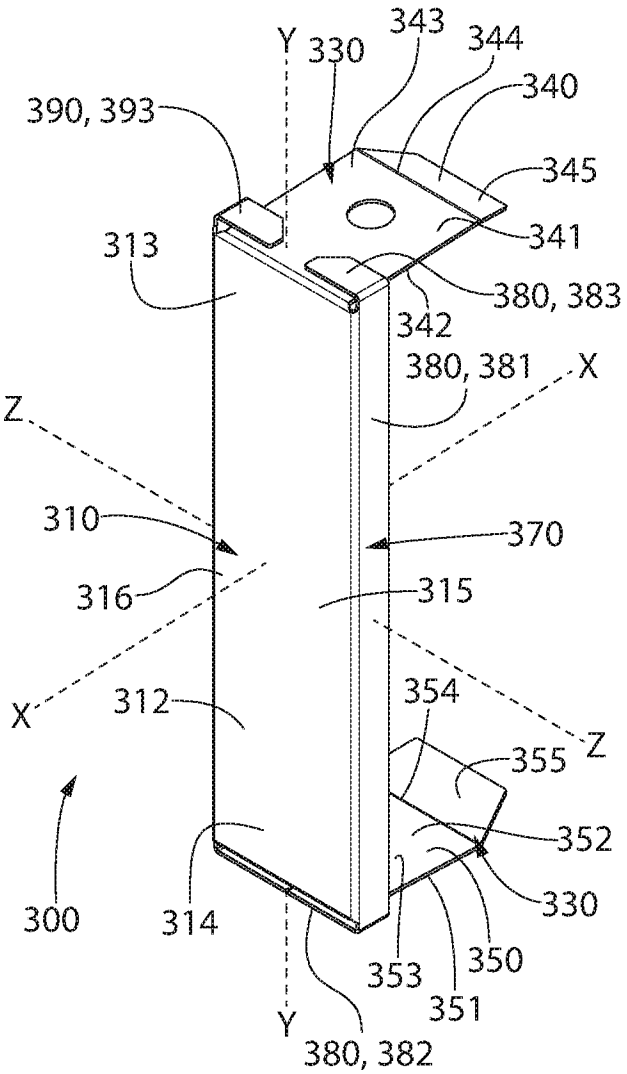
FIG. 6 is a rear top perspective view of the end cap according to the present invention.
Figure 9:
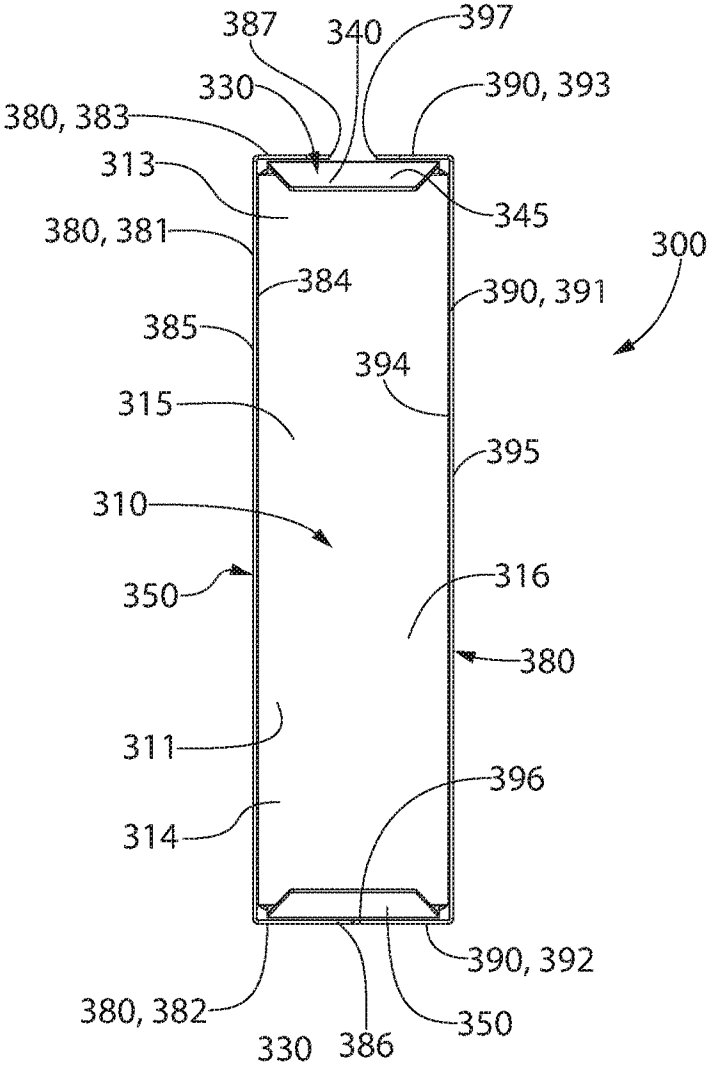
FIG. 9 is a front elevation view of the end cap according to the present invention.
Figure 8:
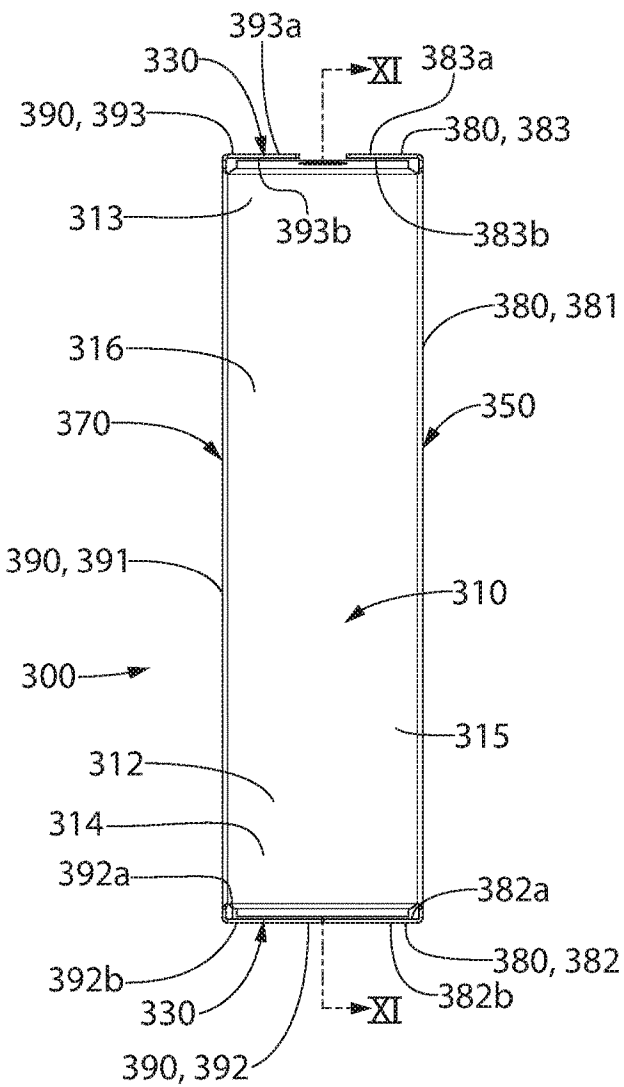
FIG. 8 is a rear elevation view of the end cap according to the present invention.
Figure 10:
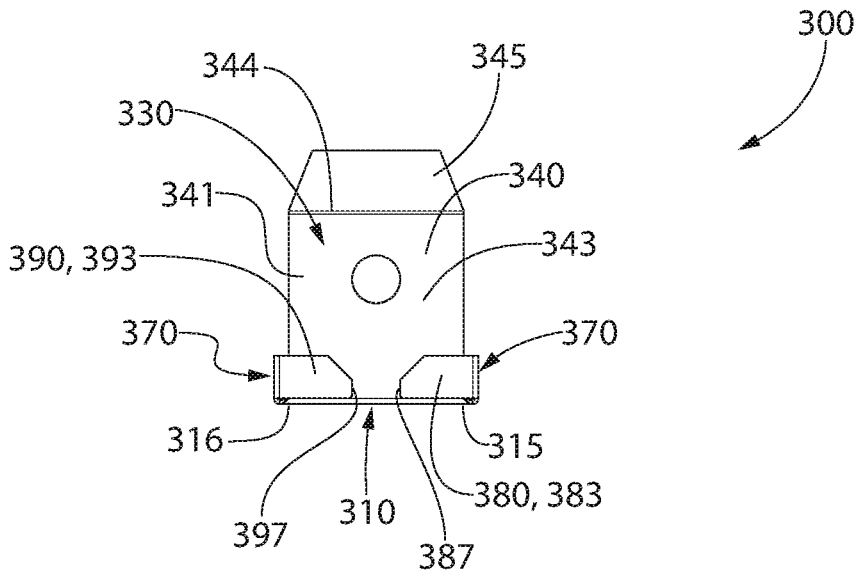
FIG. 10 is top view of the end cap according to the present invention.
Figure 11:
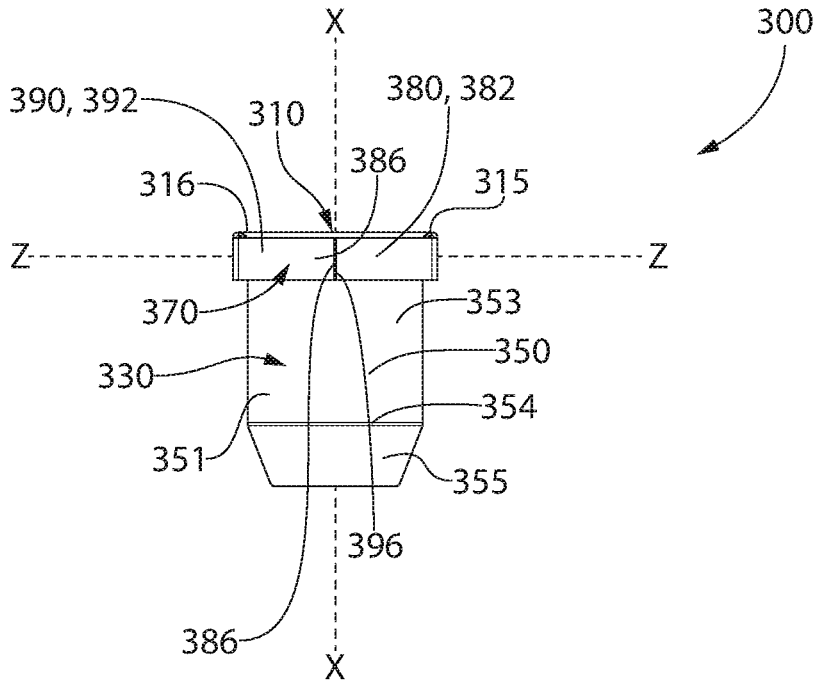
FIG. 11 is a bottom view of the end cap according to the present invention.
Figure 12:
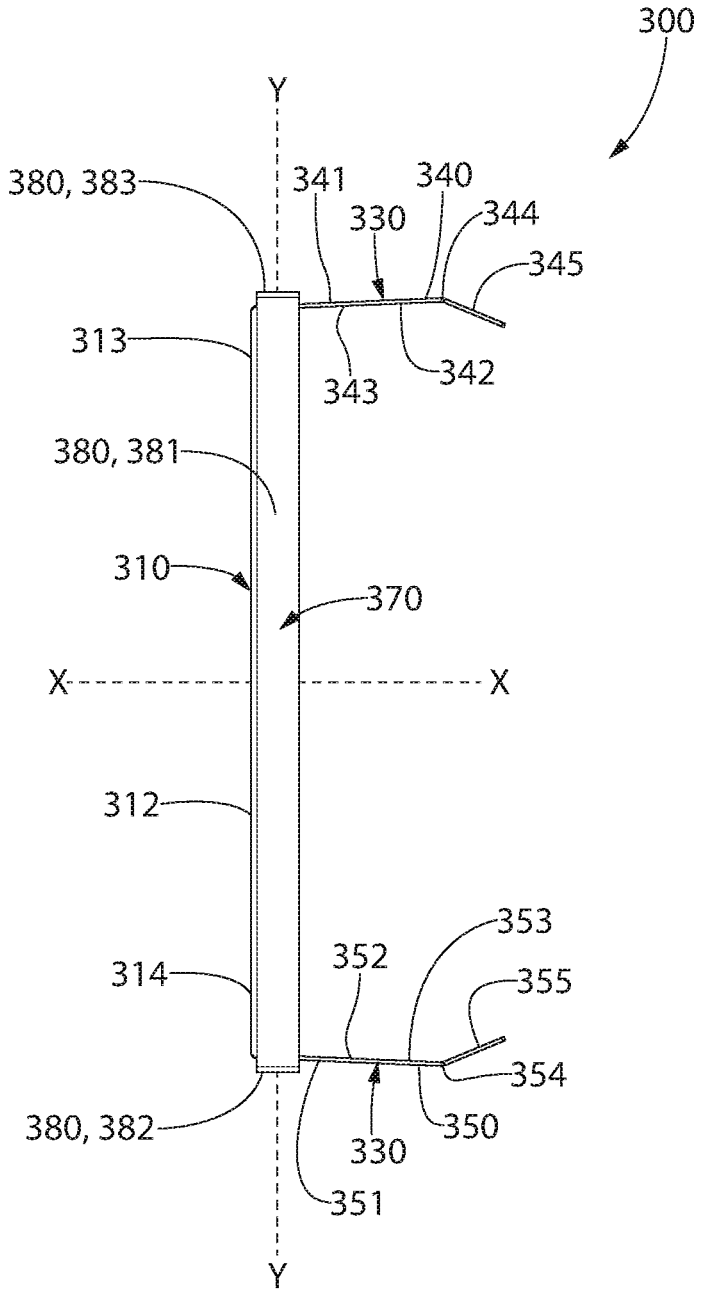
FIG. 12 is a side view of the end cap according to the present invention.

Referring to FIGS. 1, 4, and 5, a building system 1 is generally depicted. FIG. 1 illustrates the ceiling system 1 comprising a support structure 50 and a plurality of panel assemblies 100 mounted to the support structure 50, wherein the ceiling system 1 forms a ceiling for an interior room 2 (also referred to herein as "active space") from the vantage point of looking up at the ceiling system 1 from below in the active space 2. FIG. 2 illustrates a close-up of the ceiling system 1 by itself from the vantage point of looking down at the ceiling system 1 from above in a plenum 3. FIG. 3 illustrates a close-up of the ceiling system 1 by itself from the vantage point of looking upward at the ceiling system 1 from below in the active space 2.

The plenum 3 is defined by the space above the support structure 50 and the panel assemblies 100 and below a structural boundary (i.e., subfloor of the adjacent floor, structural roof, skylight, etc.). The plenum 3 provides space for mechanical lines within a building (e.g., HVAC, plumbing, etc.). The active space 2 provides room for the building occupants during normal intended use of the building (e.g., in an office building, the active space would be occupied by offices containing computers, lamps, etc.). The For the purposes of this invention, the phrase "ceiling system" may be used in place of "building system," however, the present invention is not limited to only ceiling systems.

The overhead support structure 50 may be a grid support that is configured for mounting in a suspended manner from an overhead building support structure via appropriate hanger elements, such as for example without limitation fasteners, hangers, wires, cables, hooks, rods, struts, etc. Although not pictured, in other embodiments include the support structure 50 may be a wall surface—e.g., dry wall, structural wall between floors of a building. In the exemplified embodiment the support structure 50 may include a plurality of grid support members 51 that are arranged parallel to one another. As shown in FIG. 1, in certain embodiments the support structure 50 may include both longitudinal grid support elements and lateral grid support elements that intersect one another. The use of support structure 50 of these types is generally well known for forming a suspended ceiling in a commercial building (or any other building or space as may be desired).

The support member 51 may be an inverted T-bar comprising a horizontal flange 52 and a vertical web 53. The inverted T-bar may further comprise a bulb 54 atop the vertical web 53. The plurality of first grid support members 51 may be substantially parallel to each other. Although not pictured, a plurality of second grid support members may be substantially perpendicular to the first grid support members 51. The plenum 3 exists above the support structure 50, and the active space 2 exists below the support structure 50. In some embodiments, the ceiling system 1 comprises at least one suspended support member 51 that is a strut.

The ceiling system 1 may further comprise at least one ceiling panel assembly 100 mounted to the overhead support structure 50 so as to be suspended below the overhead support structure 50 in a vertical orientation.

Referring now to FIGS. 2 and 3, the panel assembly 100 of the present invention comprises a panel body 200 and at least one end cap 300.

The panel body 200 may comprise a first wall 205 (also referred to as a "front wall"), a second wall 206 (also referred to as a "rear wall"), a bottom portion 207 (also referred to as a "bottom wall"), and a top portion 208 (also referred to as a "top wall"). As discussed further herein, the first wall 205, the second wall 206, the bottom portion 207, and the top portion 208 may collectively define an internal cavity 260 within the panel body 200.

The first wall 205 may be substantially vertical—also referred to herein as a "first vertical wall" 205. The second wall 206 may be substantially vertical—also referred to herein as a "second vertical wall" 206. The bottom portion 207 may extend from the first wall 205 to the second wall 206. The bottom portion 207 may be substantially horizontal—also referred to herein as a "bottom horizontal portion" 207. The top portion 208 may extend from the first wall 205 to the second wall 206. The top portion 208 may be substantially horizontal—also referred to herein as a "top horizontal portion" 208. The panel body 200 may further comprise a mounting portion 250 that extends upward from the top portion 208—as discussed further herein.

The panel body 200 may be attached to the support structure 50 by an attachment hardware 80. The attachment hardware 80 may be capable of attachment to the mounting portion 250 of the panel body as well as the mounting flange 52 of the support structure 51.

The panel body 200 comprises an outer surface 201 that is opposite an inner surface 202. The outer surface 201 comprises a first major outer surface 211 that is opposite a second major outer surface 212. The first wall 205 may comprise the first major outer surface 211. The second wall 206 may comprise the second major outer surface 212. The outer surface 201 further comprises a top outer surface 213 that is opposite a bottom outer surface 214. The top portion 208 may comprise the top outer surface 213. The bottom portion 207 may comprise the bottom outer surface 214. The top and bottom outer surfaces 213, 214 intersect the first and second major outer surfaces 211, 212. The first major outer surface 211 may extend from the top outer surface 213 to the bottom outer surface 214. The second major outer surface 212 may extend from the top outer surface 213 to the bottom outer surface 214.

The first and second major outer surfaces 211, 212 may be parallel. In other embodiments, the first and second major outer surfaces 211, 212 may not be parallel (not shown). The top and bottom outer surfaces 213, 214 may be parallel. In other embodiments, the top and bottom outer surfaces 213, 214 may not be parallel (not shown). The first and second major outer surfaces 211, 212 may each independently be perpendicular to the top outer surface 213. In other embodiments, the first and second major outer surfaces 211, 212 may each independently be oblique to the top outer surface (not shown). The first and second major outer surfaces 211, 212 may each independently be perpendicular to the bottom outer surface 214. In other embodiments, the first and second major outer surfaces 211, 212 may each independently be oblique to the bottom outer surface 214 (not shown).

The inner surface 202 may comprises a first major inner surface 221 that is opposite a second major inner surface 222. The first wall 205 may comprise the first major inner surface 221. The second wall 206 may comprise the second major inner surface 222. The inner surface 202 may further comprises a top inner surface 223 that is opposite a bottom inner surface 224. The top portion 208 may comprise the top inner surface 223. The bottom portion 207 may comprise the bottom inner surface 224. The top and bottom inner surfaces 223, 224 intersect the first and second inner major surfaces 221, 222. The first major inner surface 221 may extend from the top inner surface 223 to the bottom inner surface 224. The second major inner surface 222 may extend from the top inner surface 223 to the bottom inner surface 224.

The first and second major inner surfaces 221, 222 may be parallel. In other embodiments, the first and second major inner surfaces 221, 222 may not be parallel (not shown). The top and bottom inner surfaces 223, 224 may be parallel. In other embodiments, the top and bottom inner surfaces 223, 224 may not be parallel (not shown). The first and second major inner surfaces 221, 222 may each independently be perpendicular to the top inner surface 223. In other embodiments, the first and second major inner surfaces 221, 222 may each independently be oblique to the top inner surface 223 (not shown). The first and second major inner surfaces 221, 222 may each independently be perpendicular to the bottom inner surface 224. In other embodiments, the first and second major inner surfaces 221, 222 may each independently be oblique to the bottom outer surface 224 (not shown).

As discussed further herein, the first major inner surface 221, the second major inner surface 222, the top inner surface 223, and the bottom inner surface 224 may collectively define the internal cavity 260 within the panel body 200.

The panel body 200 may comprise a plurality of apertures 209 (also referred to as "perforations") present on at least one of the first wall 205 and/or the second wall 206. The apertures 209 may extend from the outer surface 201 to the inner surface 202 of the panel body 200. Specifically, a plurality of apertures 209 may extend from the first major outer surface 211 of the first wall 205 to the first inner surface 221 of the first wall 205. A plurality of apertures 209 may extend from the second major outer surface 212 of the second wall 206 to the second inner surface 222 of the second wall 206. The apertures 209 may be of any suitable shape—including but not limited to circular, polygonal, or ovular. The apertures 209 may be a combination of different shapes.

The panel body 200 may further comprise a mounting portion 250 that extends upward from the top portion 208 of the panel body 200. The mounting portion 250 may extends upward from top outer surface 213 of the panel body 200. The mounting portion 250 may be t-shaped and comprise a vertical web 251 and a support flange 252. The vertical web 251 may extend upwards from the top portion 208 of the panel body 200, and the support flange 252 may extend out laterally from an upper portion of the vertical web 251.

The panel body 200 may be formed from metal, plastic, or combinations thereof. In one embodiment, the panel body 200 may be formed from a single sheet of metal that is bent into the shape of the panel body 200, wherein the perforations are punched into the sheet.

Figure 19:
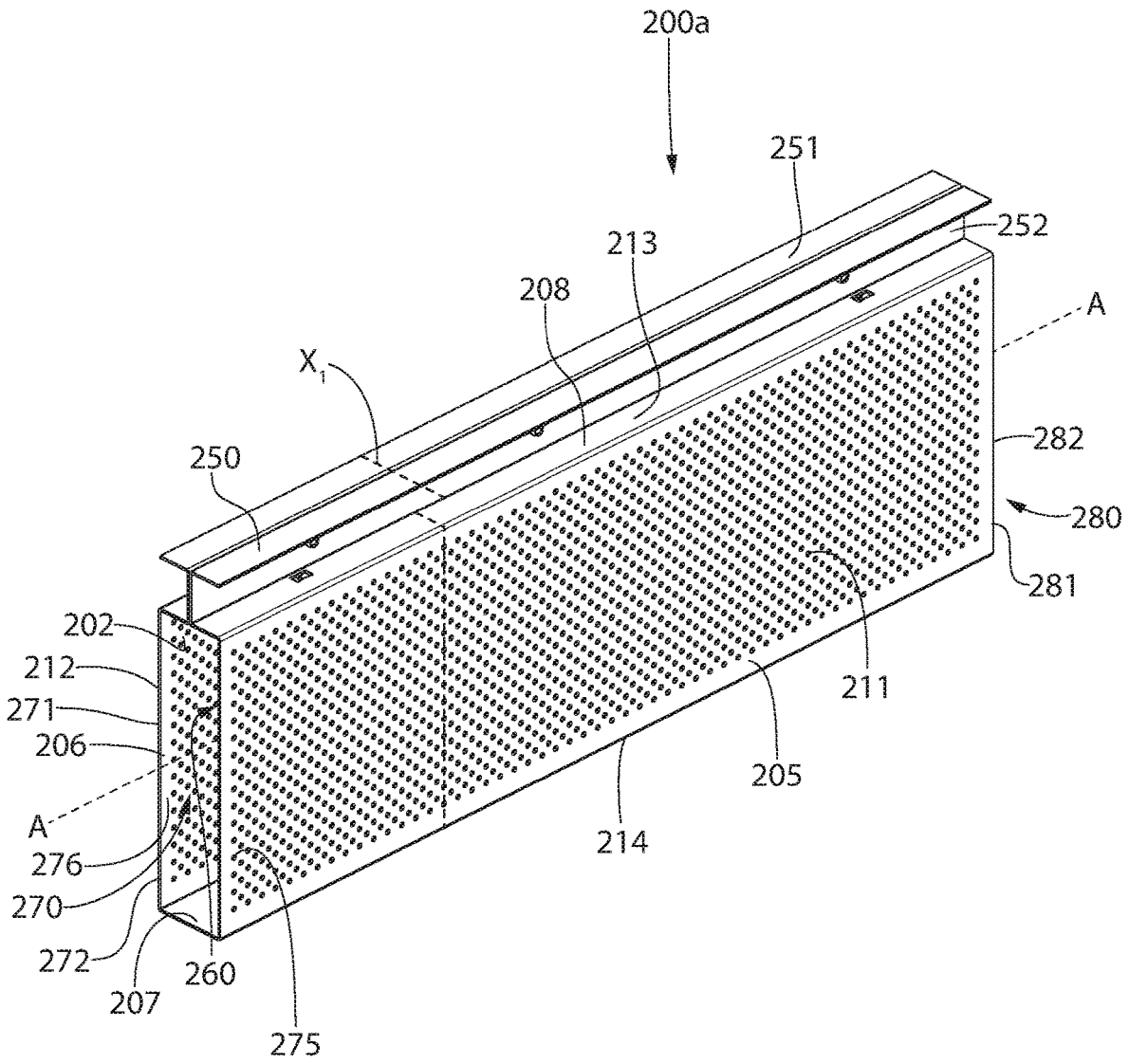
FIG. 19 is a perspective view of a factory-supplied panel body.
Figure 20:
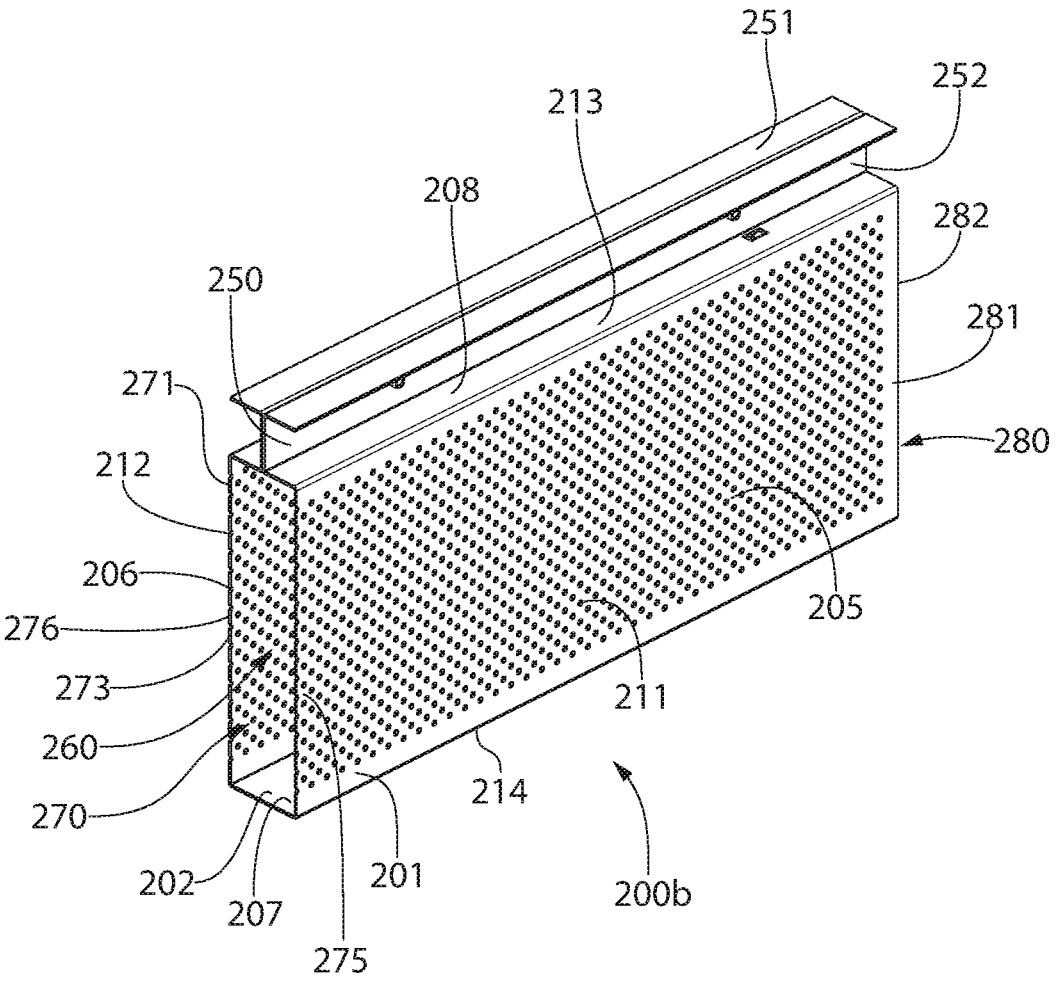
FIG. 20 is a perspective view of a non-factory-supplied panel body.
Figure 21:
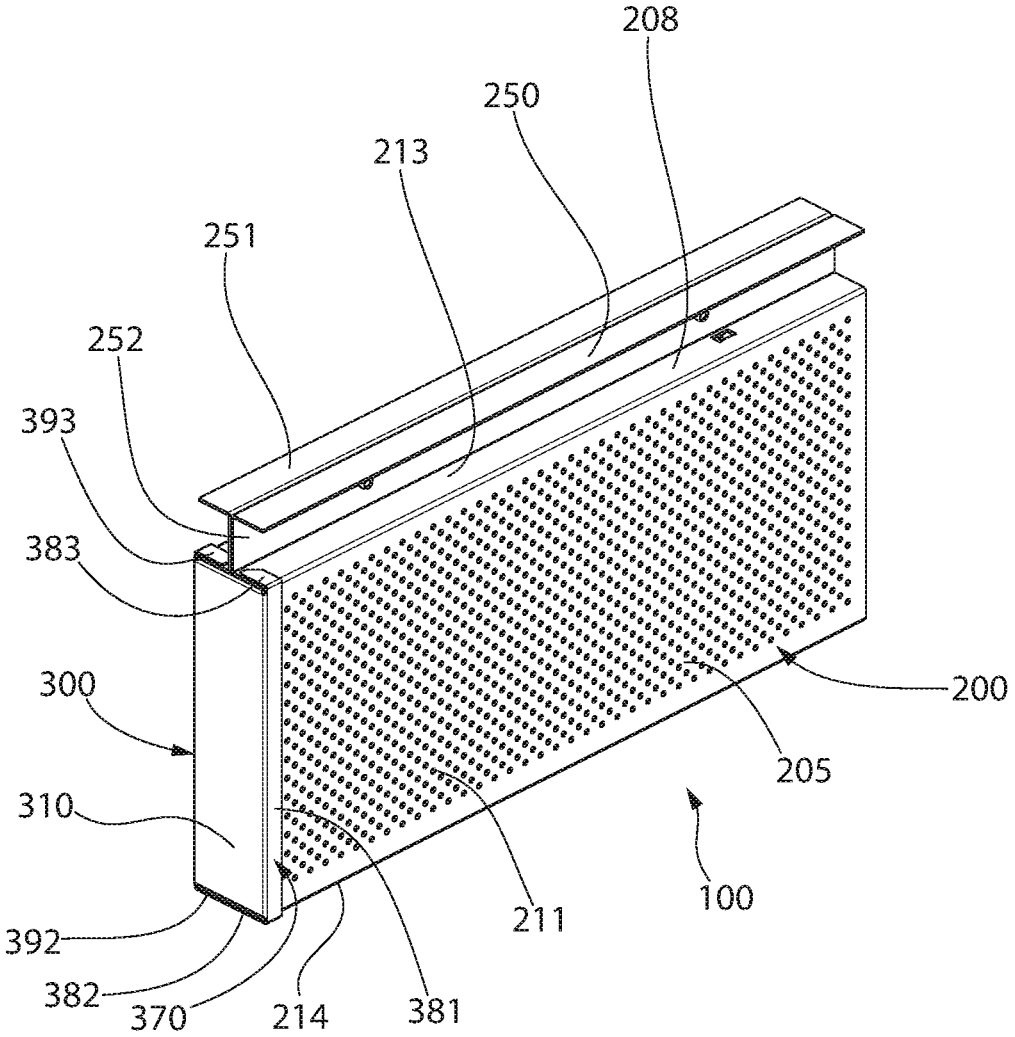
FIG. 21 is a perspective view of a panel assembly formed from the post-cut panel body of FIG. 20.
Figure 23:
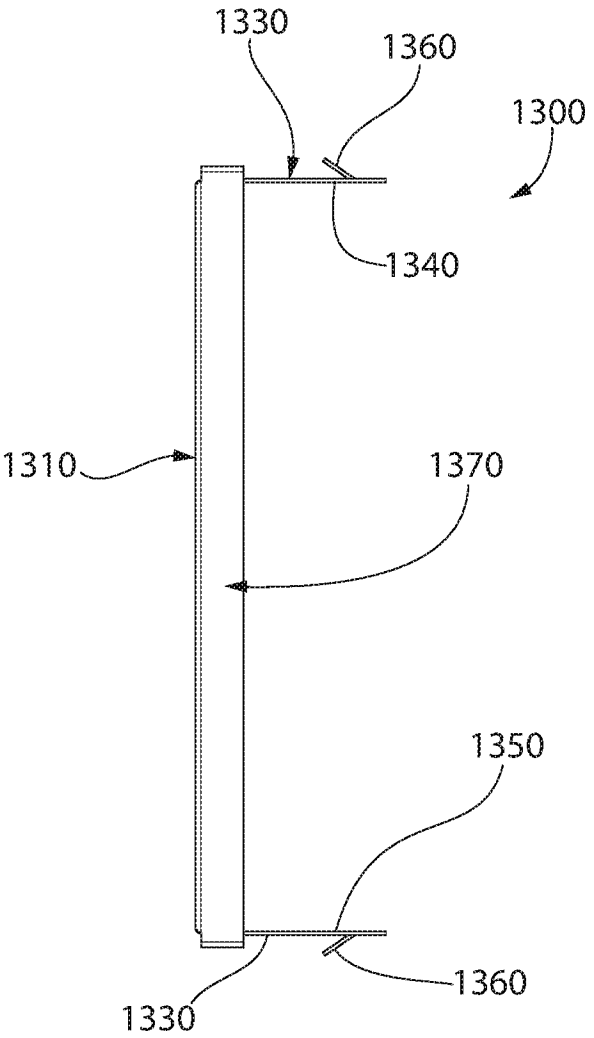
FIG. 23 is a side view of the end cap according to another embodiment of the present invention end cap according to the present invention.
Figure 22:
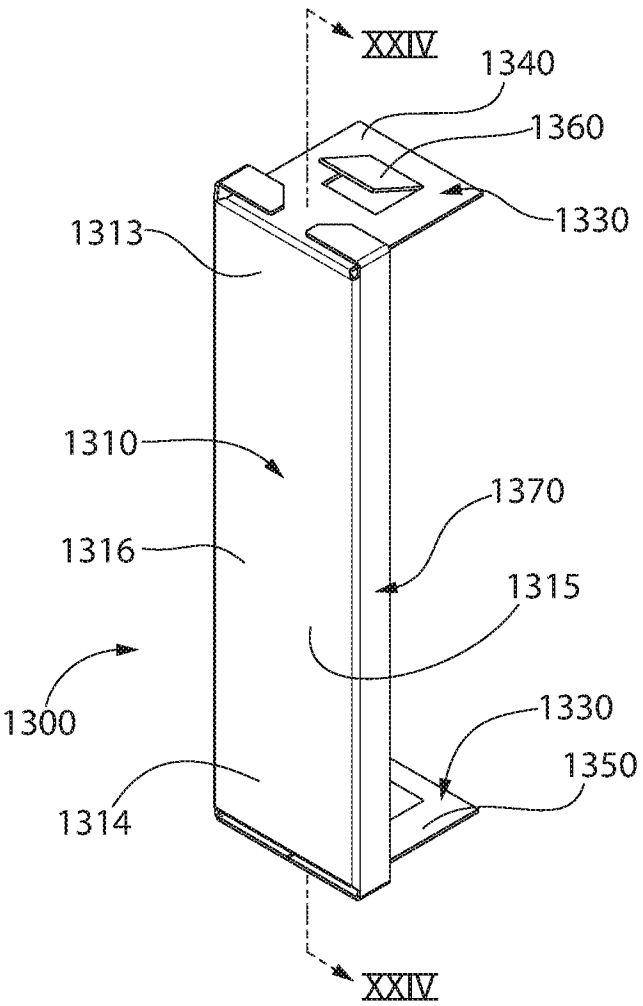
FIG. 22 is a rear top perspective view of an end cap according to another embodiment of the present invention.
Figure 24:
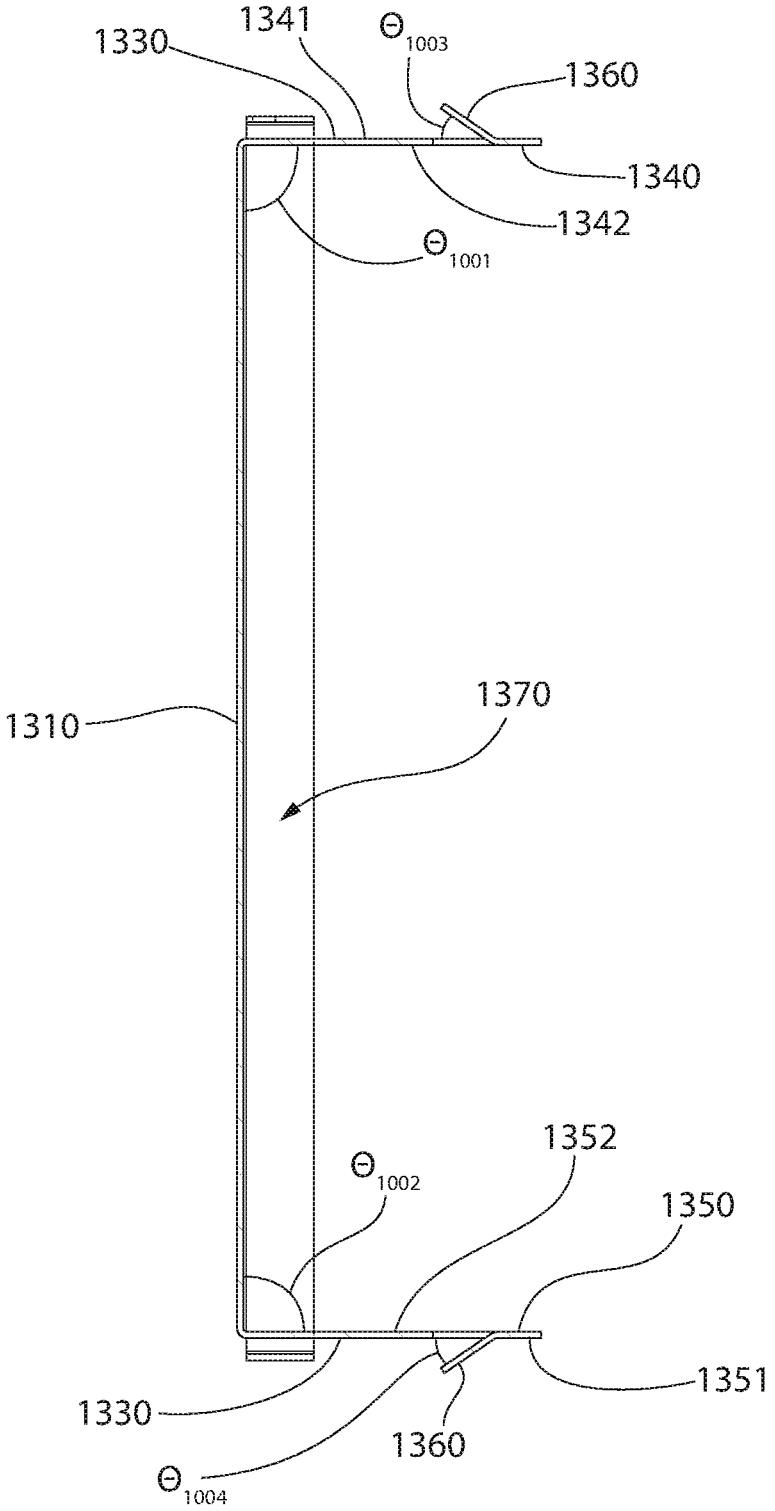
FIG. 24 is a cross-sectional view of the end cap according to another embodiment of the present invention, the cross-sectional view being taken along line XV-XV of FIG. 22.
Figure 25:
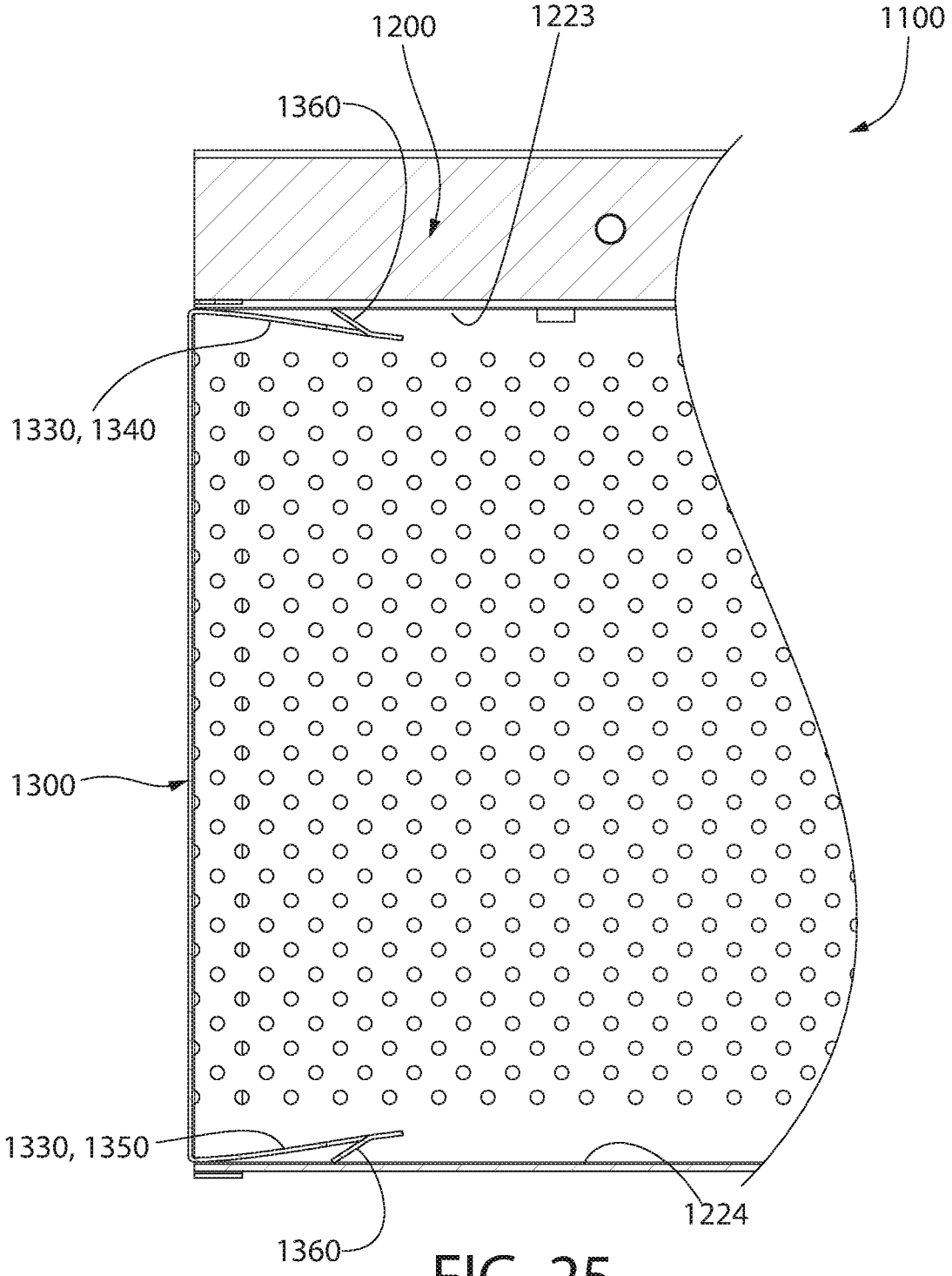
FIG. 25 is a cross-sectional view of a panel assembly according to another embodiment of the present invention, the panel assembly formed with the end cap of FIGS. 22-24.

Referring now to FIGS. 19 and 20, the panel body 200 may extend along a longitudinal axis A-A. The panel body 200 may further comprise a first side edge 271 that is opposite a second side edge 281. The first side edge 271 may be collectively formed from a combination of first end portions of the first wall 205, the second wall 206, the bottom portion 207, and the top portion 208. The second side edge 281 may be collectively formed from a combination of second end portions of the first wall 205, the second wall 206, the bottom portion 207, and the top portion 208—whereby the first end portions are opposite the second end portions along the longitudinal axis A-A. The panel body 200 may have a length as measured from the first side edge 271 to the second side edge 281 along the longitudinal axis A-A. The length of the panel body 200 may range from about 12 inches to about 144 inches—including all distances and subranges there-between.

The panel body 200 may comprise a first open end 270 that is defined by the first side edge 271 of the panel body 200. The panel body 200 may comprise a second open end 280 that is defined by the second side edge 281 of the panel body 200. The first and second open ends 270, 280 may intersects the longitudinal axis A-A. In some embodiments, the panel body 200 may comprise only a single open end—e.g., only the first open end 270 (not pictured)

Referring now to FIGS. 19 and 20, the first side edge 271 of the panel body 200 may be a factory-supplied first side edge 272. The phrase "factory-supplied" refers to a component supplied directly from a manufacturer, whereby no customization or modifications has been performed in the field. For example, a factory-supplied panel body 200*a* is one that is supplied off-the-shelf from a building materials distributor, whereby the no customization or modification has been performed at the time of installation of the ceiling system. As shown in FIG. 19, the factory-supplied first side edge 271 may comprise a non-perforated portion extending from the bottom wall 207 to the top wall 208. The non-perforated portion adds aesthetic value to the overall panel assembly. The second side edge 281 may independently also be a factory-supplied second side edge that also comprises the non-perforated portion.

The first side edge 271 of the panel body 200 may also be a non-factory-supplied first side edge 273. The phrase "non-factory-supplied" refers to a panel body 200*b* that may have started as a factory-supplied panel body 200*a*, but has been customized/modified in the field by being cut at a cut point $X_1$ along the longitudinal axis A-A such that the resulting panel body 200*b* has a custom length. The phrase "custom-cut" may be used interchangeably with "non-factory-supplied." In a non-limiting example, a panel body 200 may be cut at the cut point $X_1$ at the time of installation of the ceiling system. The cut point $X_1$ may be located at any point along the longitudinal axis A-A and extend transverse to the longitudinal axis A-A. The second side edge 281 may be a non-factory-supplied second side edge (not pictured).

Referring now to FIG. 1, with the inclusion of custom-cut panel bodies 200*b*, the ceiling system 1 of the present invention may include a plurality of panel assemblies 100*b* that have custom lengths. The non-factory supplied panel assemblies 100*b* may be used in combination with factory-supplied panel assemblies 100*a* within a single ceiling system 1.

Customizing the panel body 200 outside of the factory and/or at the time of installation may create issues with respect to desired aesthetics of the panel assembly 100. Specifically, contractors or ceiling installers may lack specialized equipment needed for the non-factory supplied edge 273 to be cut cleanly and without imperfections (such as bending, serrated portions, jagged texture). Furthermore, for a panel body 200 comprising fs 209, custom cutting may result in a non-factory supplied edge 273 that has rough texture due to the cut edges 273 being formed from portions of the perforations—as well as perforations 209 extend to the first and/or second side edge 271, 272 depending on which edge of the panel body 200 has been cut. The end cap 300 of the present invention solves these aesthetic issues.

Referring now to FIGS. 6-13, the end cap 300 of the present invention comprises a face plate 310, an insertion portion 330, and a concealment portion 370. The face plate 310 comprises an inner surface 311 that is opposite an outer surface 312. The face plate 310 comprises an upper end 313 that is opposite a lower end 314. The face plate 310 may extend longitudinally along a Y-axis such that the Y-axis intersects both the upper and lower ends 313, 314 of the face plate 310. An X-axis and Z-axis also exist in perpendicular relationship to the Y-axis—creating a standard three-dimensional axis system. The face plate 310 may further comprises a first side 315 that is opposite a second side 316 that are located on opposite sides of a first plane formed by the X-axis and Y-axis (the first plane may be referred to as the X-Y plane).

The inner surface 311 of the face plate 310 may be coplanar with a second plane formed by the Y-axis and the Z-axis (the second plane may also be referred to as the Y-Z plane). A third plane may exist as formed between the X-axis and the Z-axis (referred to as the X-Z plane).

The insertion portion 330 comprises a first insertion plate 340 and a second insertion plate 350. The first insertion plate 340 may have an outer surface 341 that is opposite an inner surface 342. The outer surface 341 may be parallel to the immediately adjacent inner surface 342 of the first insertion plate 340. The second insertion plate 350 may have an outer surface 351 that is opposite an inner surface 352. The outer surface 351 may be parallel to the immediately adjacent inner surface 352 of the second insertion plate 350. The inner surface 341 of the first insertion plate 340 may face the inner surface 351 of the second insertion plate 350.

Figure 13:
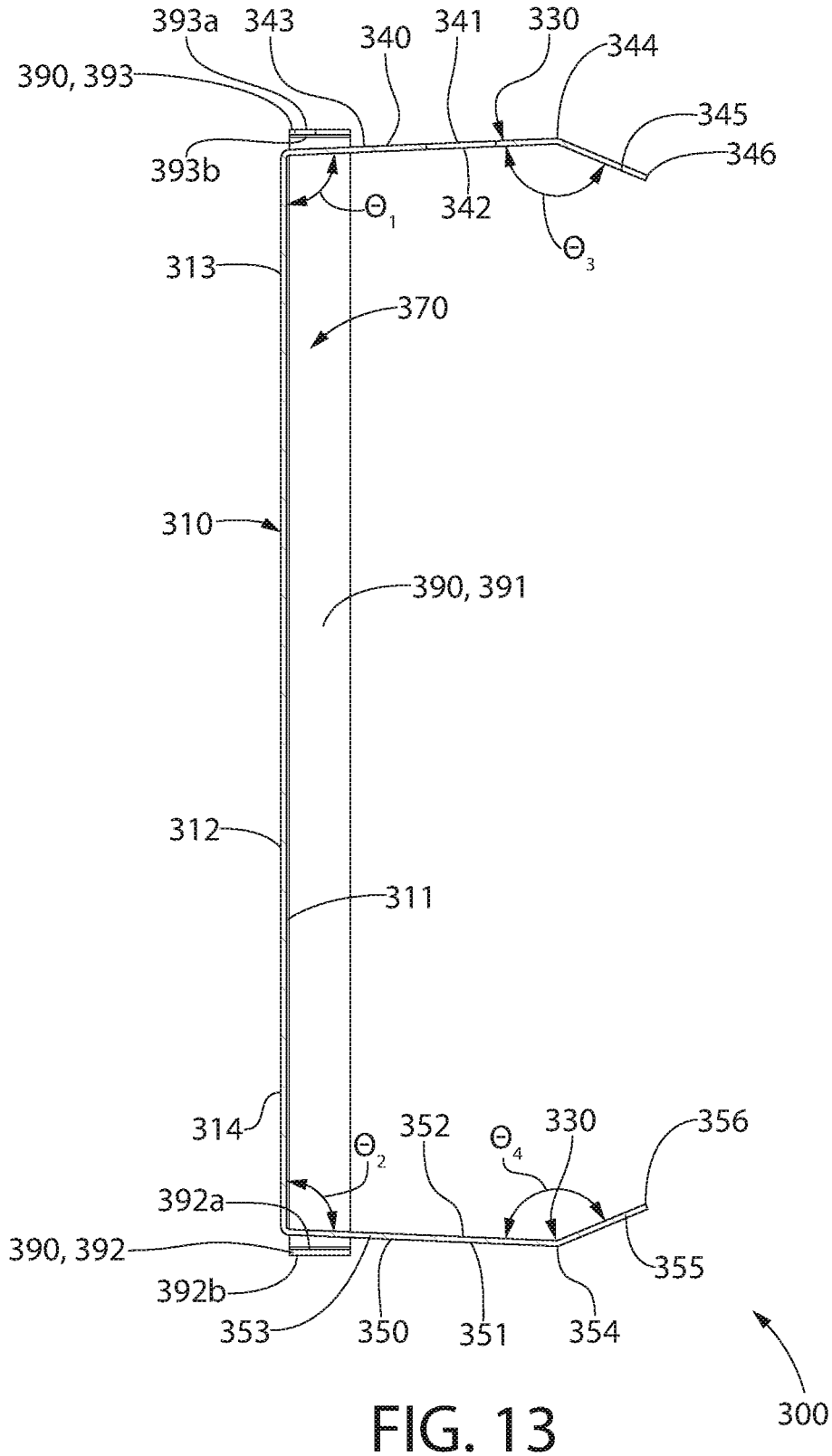
FIG. 13 is a cross-sectional view of the end cap along line XI-XI in FIG. 8.
Figure 14:
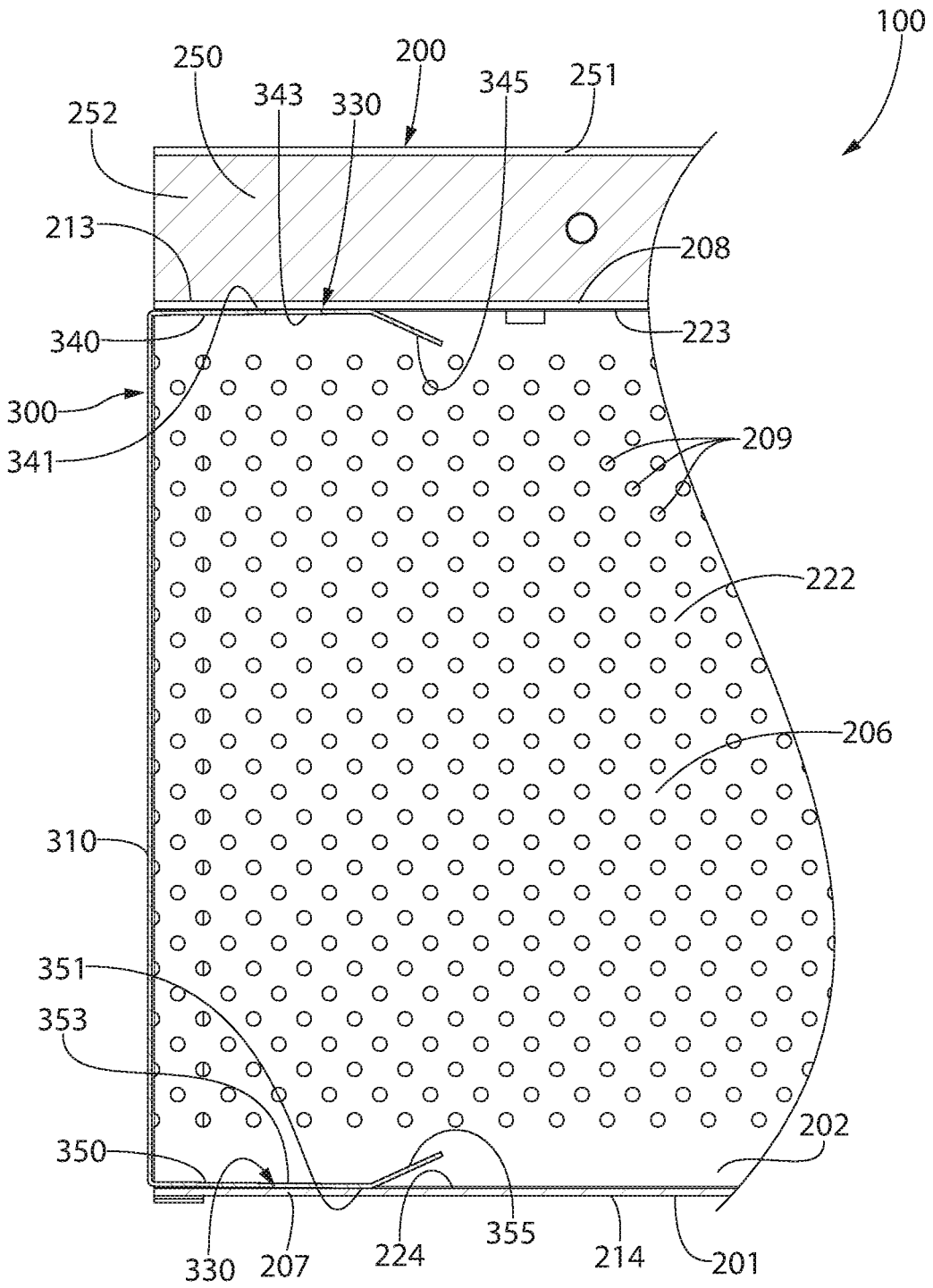
FIG. 14 is a cross-sectional view of the panel assembly along line XII-XII in FIG. 2.
Figure 15:
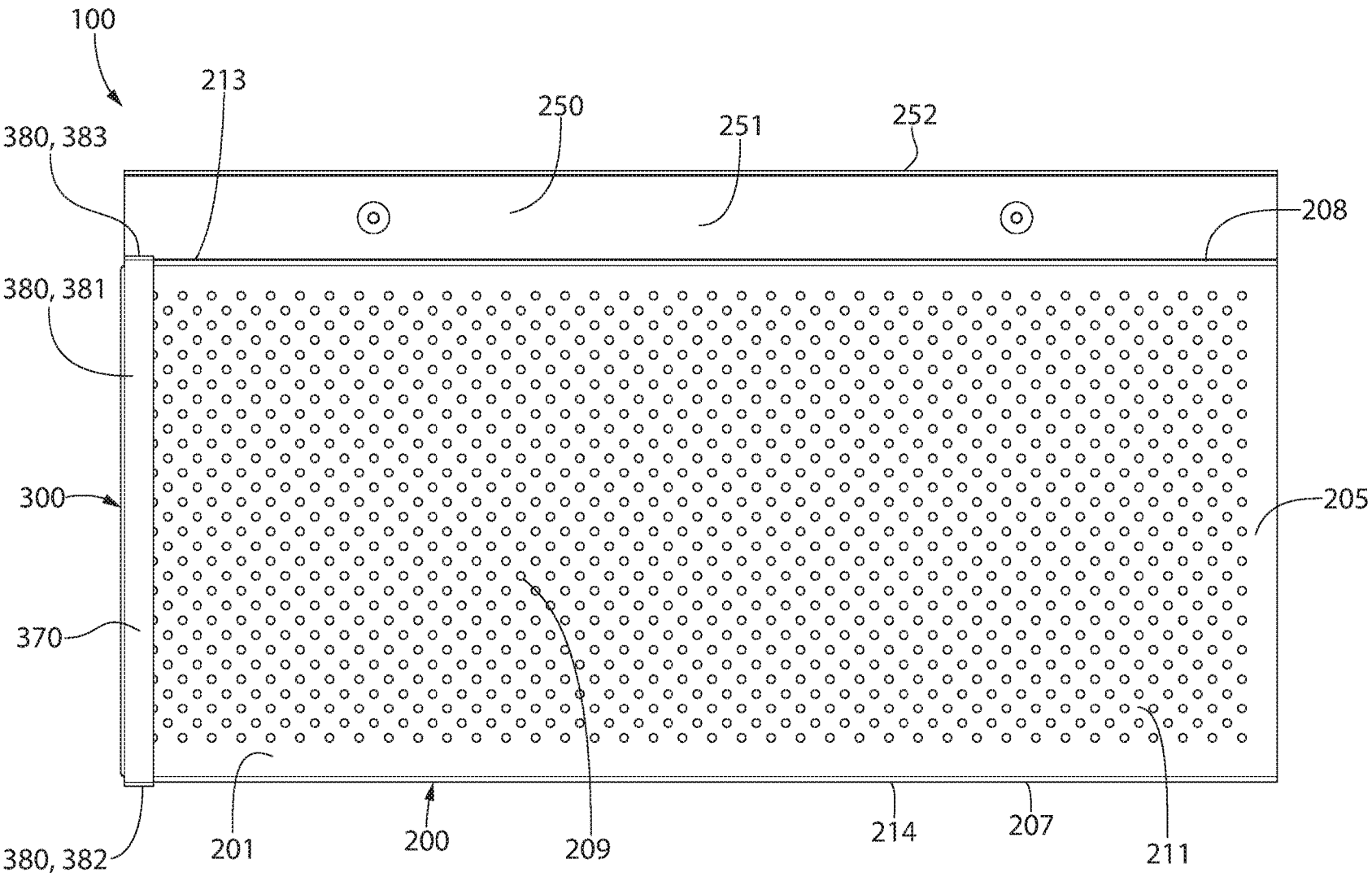
FIG. 15 is a side view of the panel assembly.
Figure 16:
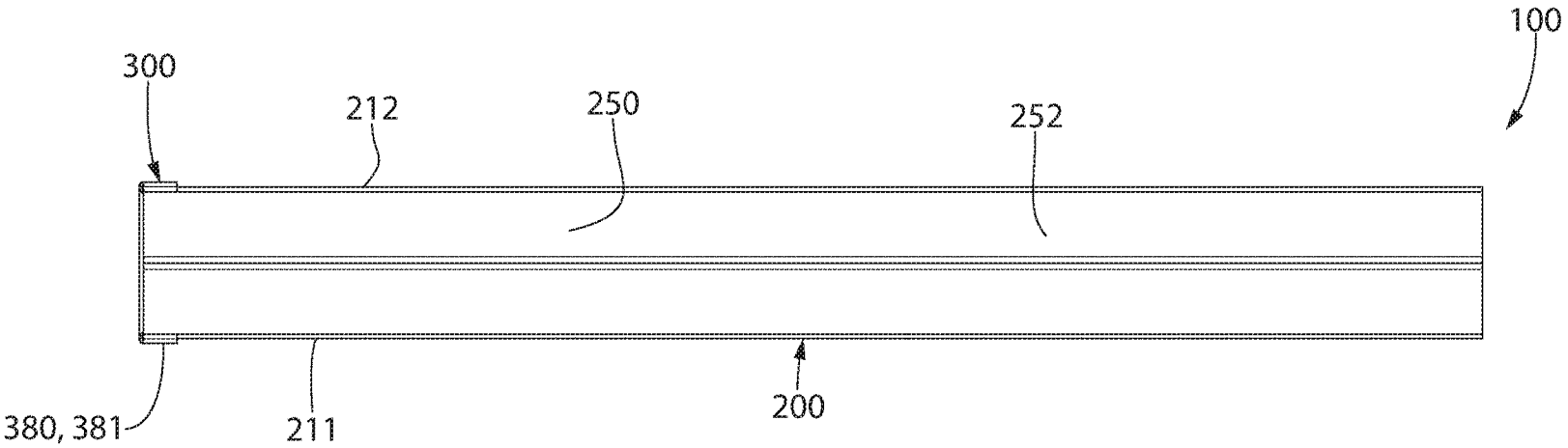
FIG. 16 is a top view of the panel assembly.
Figure 17:
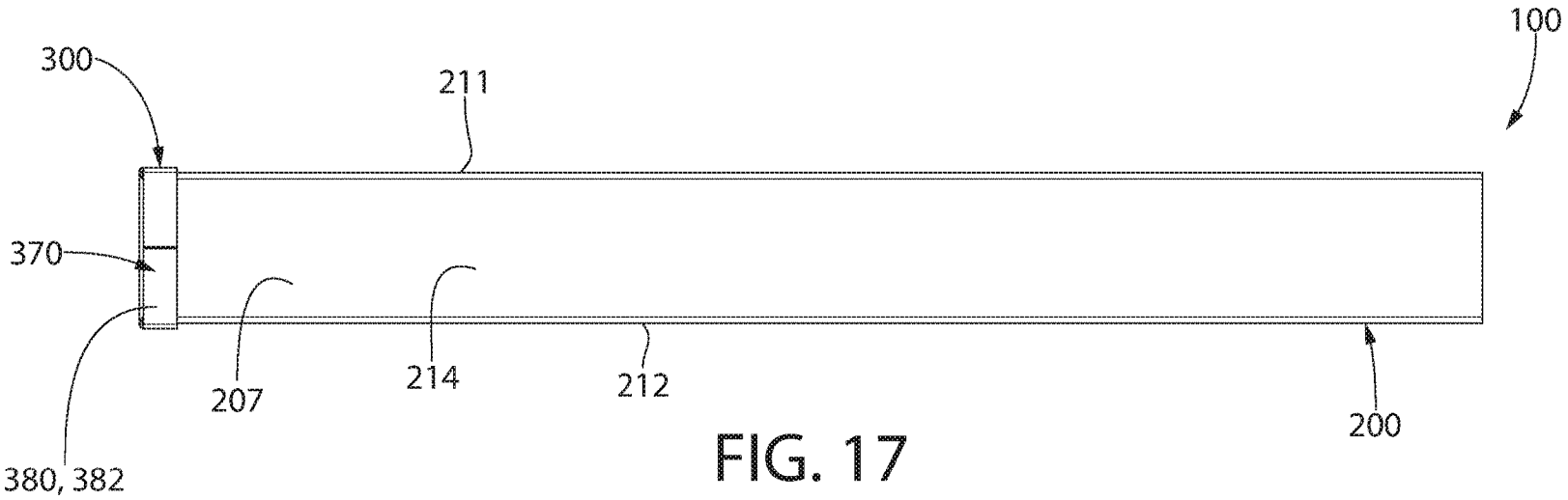
FIG. 17 is a bottom view of the panel assembly.
Figure 18:
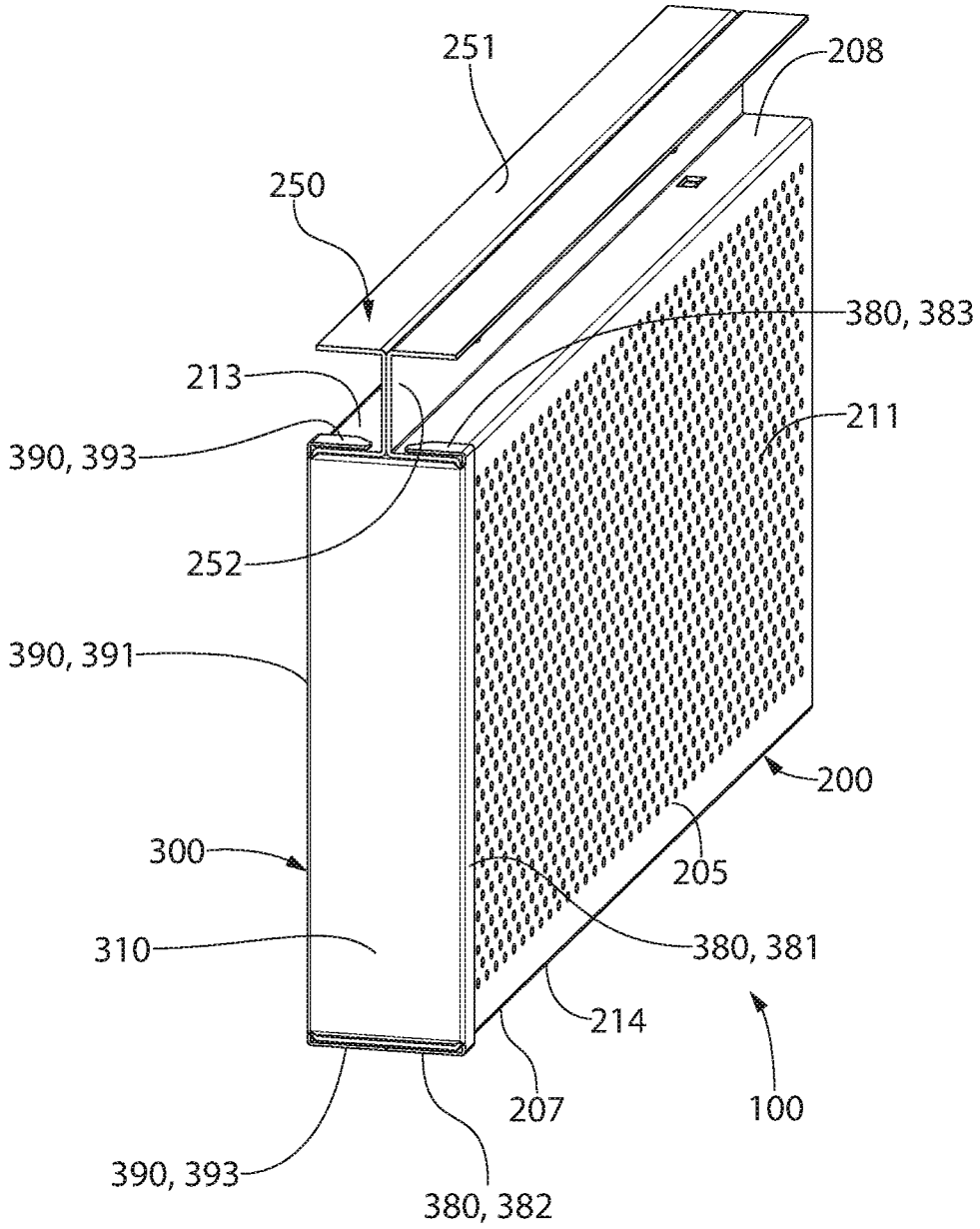
FIG. 18 is a perspective view of the panel assembly.

Referring now to FIG. 13 in particular, the first insertion plate 340 may extend from the inner surface 311 of the face plate 310. The first insertion plate 340 may extend from the inner surface 311 of the face plate 310 at the upper end 313 of the face plate 310 at a first angle $Ø_1$. The second insertion plate 350 may extend from the inner surface 311 of the face plate 310. The second insertion plate 350 may extend from the inner surface 311 of the face plate 310 at the lower end 314 of the face plate 310 at a second angle $Ø_2$.

The inner surface 341 of the first insertion plate 340 may form a continuous surface with the inner surface 311 of the face plate 310. The inner surface 351 of the second insertion plate 350 may form a continuous surface with the inner surface 311 of the face plate 310.

The first angle $Ø_1$ may be obtuse—i.e., greater than 90°. In some embodiments, the first angle $Ø_1$ ranges from greater than 90° to about 110°—including all angles and subranges there-between. In some embodiments, the first angle $Ø_1$ ranges from about 91° to about 100°—including all angles and subranges there-between. In some embodiments, the first angle $Ø_1$ ranges from 91° to about 95°—including all angles and subranges there-between. The first angle $Ø_1$ may ranges from 91° to 93°.

The second angle $Ø_2$ may be obtuse—i.e., greater than 90°. In some embodiments, the second angle $Ø_2$ ranges from greater than 90° to about 110°—including all angles and subranges there-between. In some embodiments, the second angle $Ø_2$ ranges from about 91° to about 100°—including all angles and subranges there-between. In some embodiments, the second angle $Ø_2$ ranges from 91° to about 95°—including all angles and subranges there-between. The second angle $Ø_2$ may ranges from 91° to 93°.

The first and second angles $Ø_1$, $Ø_2$ refer to the end cap 300—specifically, the first and second insertion plates 340, 350, being in an unbiased state.

Referring now to FIGS. 6-13, the first insertion plate 340 may comprise a first contact section 343 and a first entry section 345. The first contact section 343 may extend from the inner surface 311 of the face plate 310—at the upper end 313 of the face plate 310—to a distal end 344 of the first contact section 343. The first entry section 345 may extend from the distal end 344 of the first contact section 343 to a first distal end 346 of the first entry section 345. The first entry section 345 may extend downward from the distal end 344 of the first contact section 343 at an inclined orientation toward the first distal end 346 of the first entry section 345.

The first entry section 345 may extend downward from the distal end 344 of the first contact section 343 at an inclined orientation such that a third angle $Ø_3$ is formed between the first contact section 343 and the first entry section 345 on the inner surface 342 of the first insertion plate 340.

The second insertion plate 350 may comprise a second contact section 353 and a second entry section 355. The second contact section 353 may extend from the inner surface 311 of the face plate 310—at the lower end 314 of the face plate 310—to a distal end 354 of the second contact section 353. The second entry section 355 may extend from the distal end 354 of the second contact section 353 to a second distal end 356 of the second entry section 355. The second entry section 355 may extend upward from the distal end 354 of the second contact section 353 at an inclined orientation toward the first distal end 356 of the second entry section 355.

The section entry section 355 may extend upward from the distal end 354 of the second contact section 353 at an inclined orientation such that a fourth angle $Ø_4$ is formed between the second contact section 353 and the second entry section 355 on the inner surface 342 of the first insertion plate 340. The third and fourth angles $Ø_3$ $Ø_4$ may be less than 180°. The third and fourth angles $Ø_3$ $Ø_4$ may be selected such that the distance between first distal end 346 of the first entry section 345 and the second distal end 356 of the second entry section 355 is less than the distance between the top inner surface 223 and the bottom inner surface 224 of the panel body 200 when the end cap 300 is in an unbiased state. The first and second angles $Ø_1$ $Ø_2$ may be selected such that the distance between first distal end 344 of the first contact section 343 and the second distal end 354 of the second contact section 353 is greater than the distance between the top inner surface 223 and the bottom inner surface 224 of the panel body 200 when the end cap 300 is in an unbiased state.

The concealment portion 370 of the end cap 300 may comprise a first concealment plate 380 extending from the inner surface 311 of the face plate 310. The first concealment plate 380 may extend from the first side 315 of the face plate 310. The concealment portion 370 of the end cap 300 may comprise a second concealment plate 390 extending from the inner surface 311 of the face plate 310. The second concealment plate 390 may extend from the second side 316 of the face plate 310. The first concealment plate 370 may be opposite the second concealment plate 380. The first concealment plate 370 may be generally opposite the second concealment plate 380 across the X-Y plane.

The first concealment plate 380 may comprise a first middle section 381, a first lower section 382, and a first upper section 383. The first middle section 381 may have an inner surface 384 that is opposite an outer surface 385. The first middle section 381 may extend from the inner surface 311 of the face plate 310 at the first side 315 of the face plate 310. The inner surface 384 of the first middle section 381 may be coplanar with the X-Y plane.

The first lower section 382 may be adjacent to the lower end 314 of the face plate 310. The first lower section 382 may extend inwardly from the inner surface 384 of the middle section 381 and below the second insertion plate 350. The first lower section 382 may extend from the middle section 381 and terminate at a distal end 386 of the first lower section 382. The first lower section 382 may comprise an upper surface 382*a* that is opposite a lower surface 382*b*.

The first upper section 383 may be adjacent to the upper end 313 of the face plate 310. The first upper section 383 may extend inwardly from the inner surface 384 of the middle section 381 and above the first insertion plate 340. The first upper section 383 may extend from the middle section 381 and terminate at a distal end 387 of the first upper section 383. The first upper section 383 may comprise an upper surface 383*a* that is opposite a lower surface 383*b*.

The lower surface 383*b* of the first upper section 383 may face the outer surface 341 of the first insertion plate 340. The upper surface 382*a* of the first lower section 382 may face the outer surface 351 of the second insertion plate 350. A first gap may exist between the lower surface 383*b* of the first upper section 383 and the outer surface 341 of the first insertion plate 340 (i.e., the first gap may exist between the lower surface 383*b* of the first upper section 383 and the upper surface 341 of the first insertion plate 340). A second gap may exist between the upper surface 382*a* of the first lower section 382 and the outer surface 351 of the second insertion plate 350 (i.e., the second gap may exist between the upper surface 382*a* of the first lower section 382 and the lower surface 351 of the second insertion plate 350).

The first concealment plate 380 may wrap around a first side portion 275 of the first side edge 271 of the panel body 200. The first side portion 275 of the first side edge 271 may independently comprise a portion of the front wall 205, a portion of the bottom wall 207, and/or a portion of the top wall 208.

The second concealment plate 390 may comprise a second middle section 391, a second lower section 392, and a second upper section 393. The second middle section 391 may have an inner surface 394 that is opposite an outer surface 395. The second middle section 391 may extend from the inner surface 311 of the face plate 310 at the second side 316 of the face plate 310. The inner surface 394 of the second middle section 391 may be coplanar with the X-Y plane.

The second lower section 392 may be adjacent to the lower end 314 of the face plate 310. The second lower section 392 may extend inwardly from the inner surface 394 of the second middle section 391 and below the second insertion plate 350. The second lower section 392 may extend from the second middle section 391 and terminate at a distal end 396 of the second lower section 392. The second lower section 392 may comprise an upper surface 392*a* that is opposite a lower surface 392*b*.

The second upper section 393 may be adjacent to the upper end 313 of the face plate 310. The second upper section 393 may extend inwardly from the inner surface 394 of the second middle section 391 and above the first insertion plate 340. The second upper section 393 may extend from the second middle section 391 and terminate at a distal end 397 of the second upper section 393. The second upper section 393 may comprise an upper surface 393*a* that is opposite a lower surface 393*b*.

The lower surface 393*b* of the second upper section 393 may face the outer surface 341 of the first insertion plate 340. The upper surface 392*a* of the second lower section 392 may face the outer surface 351 of the second insertion plate 350. A third gap may exist between the lower surface 393*b* of the second upper section 393 and the outer surface 341 of the first insertion plate 340 (i.e., the first gap may exist between the lower surface 393*b* of the second upper section 393 and the upper surface 341 of the first insertion plate 340). A fourth gap may exist between the upper surface 392*a* of the second lower section 392 and the outer surface 351 of the second insertion plate 350 (i.e., the second gap may exist between the upper surface 392*a* of the second lower section 392 and the lower surface 351 of the second insertion plate 350).

The distal end 386 of the first lower section 382 may abut the distal end 396 of the second lower section 392. The distal end 387 of the first upper section 383 may not abut the distal end 397 of the second upper section 393.

The end cap 300 may be formed from metal, plastic, or combinations thereof. In one embodiment, the end cap 300 may be formed from a single sheet of metal that is bent into the shape of the end cap 300.

The end cap 300 may be coupled to the panel body 200. Specifically, a first end cap 300 may be coupled to the panel body 200 so that the insertion portion 330 extends into the internal cavity 260 of the panel body 200. This includes the first insertion plate 340 and the second insertion plate 350 extending into the internal cavity 260 of the panel body.

The end cap 300 may be coupled to the panel body 200 such that the concealment portion 370 wraps around at least a portion of the first side edge 271 of the panel body 200 and is adjacent to the outer surface 201 of the panel body 200. This includes at least one of the first concealment plate 380 and/or second concealment plate 390 being adjacent to the outer surface 201 of the panel body 200. Specifically, the first concealment plate 380 may wrap around a first side portion 275 of the first side edge 271 of the panel body 200. The first side portion 275 of the first side edge 271 may independently comprise a portion of the front wall 205, a portion of the bottom wall 207, and/or a portion of the top wall 208. The second concealment plate 390 may wrap around a second side portion 276 of the first side edge 271 of the panel body 200. The second side portion 276 of the first side edge 271 may independently comprise a portion of the rear wall 206, a portion of the bottom wall 207, and/or a portion of the top wall 208.

The end cap 300 may be coupled to the panel body 200 such that the face plate 310 encloses one of the first or second open ends 270, 280 of the internal cavity 260 of the panel body 200.

The first side portion 275 and the second side portion 276 of the first side edge 271 may exist on both the factory-supplied panel body 200*a* as well as the non-factory supplied panel body 200*b*.

During coupling of the end cap 300 to the panel body 200, the first and second entry sections 345, 355 pass the first side edge 271 (or the second side edge 281, depending on which side is being capped off) and enter the internal cavity 260. The distal ends 346, 356 of the first and second entry sections 345, 355 are separated by a distance that is less than the distance between the top inner surface 223 and the bottom inner surface 224 of the panel body 200—allowing both the first and second insertion plates 340, 350 to move into the internal cavity 260 without being blocked by any surface on the panel body 200.

As the insertion portion 300 continues to move into the internal cavity 260, the top inner surface 223 of the panel body 200 eventually contacts the first insertion plate 340 at a first contact point. The first contact point may exist on the first entry section 345. As the insertion portion 300 continues to move into the internal cavity 260, the bottom inner surface 224 of the panel body 200 eventually contacts the second insertion plate 350 at a second contact point. The second contact point may exist on the second entry section 355.

As the end cap 200 moves into the internal cavity 260, the first insertion plate 340 and the second insertion plate 350 are biased towards each other. Specifically, the first contact between the top inner surface 223 of the panel body 200 and the outer surface 341 of the first insertion plate 340 may bias the first insertion plate 340 downward toward X-Z plane. The second contact between the bottom inner surface 224 of the panel body 200 and the outer surface 351 of the second insertion plate 350 may bias the second insertion plate 350 upward toward X-Z plane. Additionally, the first contact between the top inner surface 223 of the panel body 200 and the outer surface 341 of the first insertion plate 340, and the second contact between the bottom inner surface 224 of the panel body 200 and the outer surface 351 of the second insertion plate 350 biases the first insertion plate 340 and the second insertion plate 350 toward each other and toward the X-Z plane.

The first and second contact created between the panel body 200 and the end cap 300 creates a frictional fit between the insertion portion 300 and the inner surface 202 of the panel body 200. Specifically, the first contact created between the top inner surface 223 of the panel body 200 and the outer surface 341 of the first insertion plate 340 creates a frictional fit between the insertion portion 300 and the inner surface 202 of the panel body 200. The second contact created between the bottom inner surface 224 of the panel body 200 and the outer surface 351 of the second insertion plate 350 creates a frictional fit between the insertion portion 300 and the inner surface 202 of the panel body 200.

Once coupled to the panel, the concealment portion 370 of the end cap 200 wraps around at least a portion of the first side edge 271 of the panel body 200 and is adjacent to the outer surface 201 of the panel body 200.

The inner surface 384 of the first middle section 381 of the first concealment plate 380 may face the front wall 205 of the panel body 200 that is immediately adjacent to the first side edge 271. The inner surface 384 of the first middle section 381 of the first concealment plate 380 may face the first major surface 211 of the panel body 200 that is immediately adjacent to the first side edge 271. The inner surface 394 of the second middle section 391 of the second concealment plate 390 may face the rear wall 206 of the panel body 200 that is immediately adjacent to the first side edge 271. The inner surface 394 of the second middle section 391 of the second concealment plate 390 may face the second major surface 212 of the panel body 200 that is immediately adjacent to the first side edge 271.

The lower surface 383*b* of the first upper section 383 of the first concealment plate 380 may face the top wall 208 of the panel body 200 that is immediately adjacent to the first side edge 271. The lower surface 383*b* of the first upper section 383 of the first concealment plate 380 may face the top outer surface 213 of the panel body 200 that is immediately adjacent to the first side edge 271. The lower surface 393*b* of the second upper section 393 of the second concealment plate 390 may face the top wall 208 of the panel body 200 that is immediately adjacent to the first side edge 271. The lower surface 393*b* of the second upper section 393 of the second concealment plate 390 may face the top outer surface 213 of the panel body 200 that is immediately adjacent to the first side edge 271.

The upper surface 382*a* of the first lower section 382 of the first concealment plate 380 may face the bottom wall 207 of the panel body 200 that is immediately adjacent to the first side edge 271. The upper surface 382*a* of the first lower section 382 of the first concealment plate 380 may face the bottom outer surface 214 of the panel body 200 that is immediately adjacent to the first side edge 271. The upper surface 392*a* of the second lower section 392 of the second concealment plate 390 may face bottom wall 207 of the panel body 200 that is immediately adjacent to the first side edge 271. The upper surface 392*a* of the second lower section 392 of the second concealment plate 390 may face the bottom outer surface 214 of the panel body 200 that is immediately adjacent to the first side edge 271.

When the end cap 300 is coupled to the building panel 200, a portion of the panel body 200 adjacent the first side edge 271 is located between the insertion portion 330 of the end cap 300 and the concealment portion 370 of the end cap 300. A portion of the panel body 200 may be located between the lower surface 383*b* of the first upper section 383 of the first concealment plate 380 and the top outer surface 213 of the panel body 200 that is immediately adjacent to the first side edge 271. A portion of the panel body may be located between the lower surface 393*b* of the second upper section 393 of the second concealment plate 390 and face the top outer surface 213 of the panel body 200 that is immediately adjacent to the first side edge 271. A portion of the panel body 200 may be located between the upper surface 382*a* of the first lower section 382 of the first concealment plate 380 and the bottom outer surface 214 of the panel body 200 that is immediately adjacent to the first side edge 271. A portion of the panel body 200 may be located between the upper surface 392*a* of the second lower section 392 of the second concealment plate 390 and the bottom outer surface 214 of the panel body 200 that is immediately adjacent to the first side edge 271.

It should be understood that the foregoing discussion also applies to a second end cap 300 being coupled to the second side edge 281. Therefore, the present invention may include a panel assembly 100 comprising a first and second end cap 300 attached to the first side edge 271 and the second side edge 281, respectively.

Referring now to FIGS. 19 and 20, the present invention further includes a method of forming a panel assembly 100—including both factory-supplied panel assemblies 100*a*, and custom panel assemblies 100*b* as well as installing the panel assembly within a ceiling system 1. The method includes first providing at least one end cap 300 and a first panel body 200*a*. The first panel body 200*a* may be a factory-supplied panel body that extends along a longitudinal axis A-A from a first side edge 271 to an opposite second side edge 281. Both the first side edge 271 and the second side edge 281 may be factory supplied side edges. For instance, the first side edge 271 of the factory-supplied body 200*a* may be a first factory-supplied side edge 272 and the second side edge 281 of the factory-supplied body 200*a* may be a second factory-supplied side edge 282. The factory supplied panel body 200*a* has a first length as measured from the first and second factory supplied edges 272, 282.

During customization, a cut may be formed at cut point $X_1$ on the factory-supplied panel body 200*a*, whereby the cut point $X_1$ is located along the longitudinal axis A-A at a point between the first factory-supplied side edge 272 and the second factory-supplied side edge 282. The cut at the cut point $X_1$ may be formed by any suitable tool—including tools suitable for in the field installation, such as table saw, hacksaw, chop saw, and the like. The cut at cut point X1 may extend transverse to the longitudinal axis A-A. The cut at cut point $X_1$ may extend through the entirety of the first wall 205, the second wall 206, the bottom portion 206, the top portion 207, as well as the mounting portion 250 of the panel body 100. Stated otherwise, the cut at cut point X1 may completely separate a cut portion from the remainder of the non-factory-supplied body 200*b*.

After removing the cut portion from the non-factory supplied body 200*b*, the first factory side edge 272 is replaced with the first non-factory supplied side edge 273 as the first side edge 271 of the panel body 200*b*. Stated otherwise, after cutting, the custom-cut panel body 200*b* may comprise the second factory supplied edge 282 and the first non-factory supplied side edge 273. The non-factory supplied panel body 200*b* has a second length as measured from the first non-factory supplied side edge 273 to the second factory supplied edge 282. The second length is less than the first length.

Although not pictured, the second factory-supplied side edge 282 may also be removed at a separate cut point (not pictured), whereby the second factory side edge 282 is replaced with the second non-factory supplied side edge as the second side edge 281 of the panel body 200*b*.

Referring now to FIGS. 2 and 3, the end cap 300 may then be attached to the shortened panel body 200 (i.e., the custom cut panel body 200*b*) the end cap conceals at least a portion of the non-factory side edge 273—as previously discussed. The panel assembly 100*b* may then be mounted to a support structure 51 of an overhead support grid 50 by the attachment hardware 80.

In some embodiments, the present invention may include a kit comprising at least one panel body 200 and at least one end cap 300. The kit may comprise a plurality of panel bodies 200 and a plurality of end caps 300. In some embodiments, the kit may comprise a panel body 200 having at least one factory applied end cap that is attached to at least one side edge of the panel body, whereby the other respective side edge does not have a factory applied end cap attached thereto. The factory applied end cap may be the same or different than the end cap 300 of the present invention. The factory applied end cap may be coupled to the panel body 300 by fastener and/or adhesive. Thus, the resulting panel body 100 may have one factory applied end cap that is coupled to the panel body 200 by fastener and/or adhesive and one end cap 300 that is coupled to the panel body 200 by frictional fit.

Referring to FIGS. 22-25, a panel assembly 1100 is illustrated in accordance with another embodiment of the present invention. The panel assembly 1100 is similar to the panel assembly 100 except as described herein below. The description of the panel assembly 100 above generally applies to the panel assembly 1100 described below except with regard to the differences specifically noted below. A similar numbering scheme will be used for the panel assembly 1100 as with the panel assembly 1100 except that the 1000-series of numbers will be used.

The panel assembly 1100 of this embodiment comprises an insertion portion 1300 including a first insertion plate 1340 and a second insertion plate 1350. The first insertion plate 1340 may extend from the inner surface of the face plate 1310 at the upper end at a first angle $Ø_{1001}$. The second insertion plate 1350 may extend from the inner surface of the face plate 1310 at the lower end at a second angle $Ø_{1002}$.

The first angle $Ø_{1001}$ may be a right angle—i.e., 90°. In some embodiments, the first angle $Ø_{1001}$ may be less than 90°. The second angle $Ø_{1002}$ may be a right angle—i.e., 90°. In some embodiments, the second angle $Ø_{1002}$ may be less than 90°.

The first insertion plate 1340 and second insertion plate 1350 may each independently comprises a tab 1360. The tab 1360 may extend upward from the outer surface of the first insertion plate 1340 at a third angle $Ø_{1003}$. The tab 1360 may extend upward from the outer surface of the second insertion plate 1340 at a fourth angle $Ø_{1003}$. The third and fourth angles $Ø_{1003}$, $Ø_{1004}$ may be selected such that a distal end of the tab 1360 contacts at least one of the top inner surface 1223 and/or the bottom inner surface 1224 when the end cap 1300 is coupled to the panel body 1200—thereby creating a frictional fit between the end cap 1300 and the panel body 1200 even when the first and/or second insertion plates 1340, 1350 are oriented either coplanar or inward toward the Z-X plane in an unbiased state.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An end cap for a ceiling panel of a ceiling system, the end cap comprising:

a face plate comprising an inner surface, a bottom edge, a top edge, a first side edge, and a second side edge;

a first insertion plate extending from the inner surface of the face plate at the top edge of the face plate;

a second insertion plate extending from the inner surface of the face plate at the bottom edge of the face plate;

a concealment portion extending from the inner surface of the face plate along the first and second side edges of the face plate, an upper section of the concealment portion being positioned above the first insertion plate and spaced from the first insertion plate by a first gap and a lower section of the concealment portion being positioned below the second insertion plate and spaced from the second insertion plate by a second gap.

2. The end cap according to claim 1 wherein the first gap is located between the top edge of the face plate and the upper section of the concealment portion and the second gap is located between the bottom edge of the face plate and the lower section of the concealment portion.

3. The end cap according to claim 1 wherein the first and second gaps are exposed when the end cap is viewed along an outer surface of the face plate that is opposite the inner surface of the face plate.

4. The end cap according to claim 1 wherein the upper section of the concealment portion comprises an outer edge and an inner edge, and wherein the first gap forms a first passageway that extends from a first opening that is aligned with the outer edge of the concealment portion to a second opening that is aligned with the inner edge of the concealment portion.

5. The end cap according to claim 1 further comprising:

the first insertion plate comprising a first contact section extending from the inner surface of the face plate to a distal end and a first entry section extending downwardly from the distal end of the first contact section in an inclined orientation; and the second insertion plate comprising a second contact section extending from the inner surface of the face to a distal end and a second entry section extending upwardly from the distal end of the second contact section in an inclined orientation.

6. The end cap according to claim 5 wherein the first and second entry sections are angled towards one another with increasing distance from the first and second contact sections, respectively.

7. The end cap according to claim 5 wherein the first contact section extends obliquely from the face plate in an upward direction and the first entry section extends obliquely from the first contact section in a downward direction, and wherein the second contact section extends obliquely from the face plate in a downward direction and the second entry section extends obliquely from the second contact section in an upward direction.

8. The end cap according to claim 1 wherein a height of the first and second gaps decreases moving in a direction away from the inner surface of the face plate.

9. The end cap according to claim 1 wherein the first and second insertion plates have inner surfaces that face one another, the first insertion plate extending from the inner surface of the face plate so that a first obtuse angle is formed between the inner surface of the first insertion plate and the inner surface of the face plate, and the second insertion plate extending from the inner surface of the face plate so that a second obtuse angle is formed between the inner surface of the second insertion plate and the inner surface of the face plate.

10. The end cap according to claim 1 further comprising the concealment portion comprising a first concealment plate extending from the inner surface of the face plate along the first side edge of the face plate and a second concealment plate extending from the inner surface of the face plate along the second side edge of the face plate.

11. The end cap according to claim 1 wherein the upper section of the concealment portion is cantilevered over the first insertion plate and is not coupled directly to the face plate, and wherein the lower section of the concealment portion is cantilevered below the second insertion plate and is not coupled directly to the face plate.

12. The end cap according to claim 1 wherein the upper and lower sections of the concealment portion comprise gaps that are aligned with a longitudinal axis of the face plate.

13. The end cap according to claim 1 wherein the concealment portion comprises:

a first concealment plate comprising a first middle section extending along the first side edge of the face plate, a first lower section extending inwardly from an inner surface of the first middle section and below the second insertion plate and terminating at a distal end, and a first upper section extending inwardly from the inner surface of the first middle section and above the first insertion plate and terminating at a distal end; and a second concealment plate comprising a second middle section extending along the second side edge of the face plate, a second lower section extending inwardly from an inner surface of the second middle section and below the second insertion plate and terminating at a distal end, and a second upper section extending inwardly from the inner surface of the second middle section and above the first insertion plate and terminating at a distal end.

14. The end cap according to claim 13 wherein the distal end of the first upper section and the distal end of the second upper section are spaced apart.

15. The end cap according to claim 13, wherein the distal ends of the first and second lower sections abut one another.

16. An end cap for a ceiling panel of a ceiling system, the end cap comprising:

a face plate comprising an inner surface and a longitudinal axis;

a first insertion plate extending from the inner surface of the face plate along a top end of the face plate;

a second insertion plate extending from the inner surface of the face plate along a bottom end of the face plate;

a first concealment plate comprising a middle section extending along a first side edge of the face plate, a cantilevered upper section extending from the middle section and being axially spaced apart from the top end of the face plate, and a cantilevered lower section extending from the middle section and being axially spaced apart from the bottom end of the face plate; and a second concealment plate comprising a middle section extending along a second side edge of the face plate, a cantilevered upper section extending from the middle section and being axially spaced apart from the top end of the face plate, and a cantilevered lower section extending from the middle section and being axially spaced apart from the bottom end of the face plate.

17. The end cap according to claim 16 wherein the cantilevered upper section of the first concealment plate terminates in a first distal end and the cantilevered upper section of the second concealment plate terminates in a second distal end, the first and second distal ends being spaced apart by a gap that is intersected by the longitudinal axis.

18. The end cap according to claim 16 wherein the cantilevered upper section of the first and second concealment plate comprise an outer edge and an inner edge, and wherein a passageway exists between the cantilevered upper sections of the first and second concealment plate and the first insertion plate, the passageway having a first opening at the outer edges of the cantilevered upper sections of the first and second concealment plates and a second opening at the inner edges of the cantilevered upper sections of the first and second concealment plates.

19. The end cap according to claim 16 wherein the cantilevered upper sections of the first and second concealment plates are suspended above the face plate and the first insertion plate without being coupled to the face plate and the first insertion plate, and wherein the cantilevered lower sections of the first and second concealment plates are suspended below the face plate and the second insertion plate without being coupled to the face plate and the second insertion plate.

20. An end cap for a ceiling panel of a ceiling system, the end cap comprising:

a face plate comprising an inner surface;

an insertion plate extending from the inner surface of the face plate; and a concealment portion extending from the inner surface of the face plate along first and second side edges of the face plate, the concealment portion comprising a first upper section and a second upper section that are suspended above the first insertion plate, distal ends of the first and second upper sections being spaced apart by a gap, the gap being exposed when the end cap is viewed in a direction facing an outer surface of the face plate that is opposite the inner surface wherein at least a portion of the concealment portion is disposed below a plane defined by the insertion plate.

* * * * *